US011692420B2

(12) United States Patent
Gibson et al.

(10) Patent No.: US 11,692,420 B2
(45) Date of Patent: Jul. 4, 2023

(54) SYSTEMS AND METHODS FOR MULTI-STAGE FRACTURING

(71) Applicant: The WellBoss Company, Inc., Calgary (CA)

(72) Inventors: Chad Michael Erick Gibson, The Woodlands, TX (US); Derek Slater Payne, Katy, TX (US)

(73) Assignee: The WellBoss Company, Inc., Calgary (CA)

( * ) Notice: Subject to any disclaimer, the term of this patent is extended or adjusted under 35 U.S.C. 154(b) by 65 days.

(21) Appl. No.: 17/496,717

(22) Filed: Oct. 7, 2021

(65) Prior Publication Data

US 2022/0112794 A1 Apr. 14, 2022

Related U.S. Application Data

(60) Provisional application No. 63/125,024, filed on Dec. 14, 2020, provisional application No. 63/089,631, filed on Oct. 9, 2020.

(51) Int. Cl.

| | |
|---|---|
| ***E21B 34/06*** | (2006.01) |
| ***E21B 33/12*** | (2006.01) |
| ***E21B 43/26*** | (2006.01) |
| ***E21B 23/00*** | (2006.01) |

(52) U.S. Cl.

CPC ..... *E21B 43/26* (2013.01); *E21B 23/004* (2013.01); *E21B 33/12* (2013.01); *E21B 34/06* (2013.01)

(58) Field of Classification Search

CPC ..... E21B 33/12; E21B 34/06; E21B 23/004

See application file for complete search history.

(56) References Cited

U.S. PATENT DOCUMENTS

| | | | |
|---|---|---|---|
| 7,387,165 | B2 | 6/2008 | Lopez de Cardenas et al. |
| 8,672,036 | B2 | 3/2014 | Hughes et al. |
| 9,500,063 | B2 | 11/2016 | Greenan |
| 9,556,714 | B2 | 1/2017 | Hughes et al. |
| 9,683,419 | B2 | 6/2017 | Coon |
| 9,995,111 | B2 | 6/2018 | Hughes et al. |
| 10,001,001 | B2 | 6/2018 | Jani |
| 10,100,612 | B2 * | 10/2018 | Lisowski ..... E21B 34/14 |
| 10,156,124 | B2 | 12/2018 | Guzman et al. |
| 2011/0240311 | A1 | 10/2011 | Robison et al. |
| 2013/0206402 | A1 | 8/2013 | Coon |
| 2013/0299200 | A1 | 11/2013 | Hughes et al. |
| 2014/0238689 | A1 | 8/2014 | Hughes et al. |
| 2015/0060076 | A1 | 3/2015 | Campbell et al. |
| 2015/0114718 | A1 | 4/2015 | Hughes et al. |
| 2015/0330185 | A1 | 11/2015 | Hughes et al. |
| 2016/0258260 | A1 | 9/2016 | Coon |
| 2016/0298404 | A1 | 10/2016 | Beckett et al. |
| 2017/0051574 | A1 | 2/2017 | Hughes et al. |
| 2017/0175488 | A1 | 6/2017 | Lisowski et al. |

(Continued)

*Primary Examiner* — Catherine Loikith

(74) *Attorney, Agent, or Firm* — Kearney, McWilliams & Davis, PLLC; John M. DeBoer

(57) ABSTRACT

A downhole system for multistage fracturing having a first cluster of valves, and a second cluster of valves downhole from the first cluster. Each of the first and second cluster of valves has a frac valve. At least one of the first and the second cluster of valves has a flex valve. A single plugging device is used to open all of the valves in the second cluster, but leaves all valves in the first cluster closed.

20 Claims, 21 Drawing Sheets

(56) References Cited

U.S. PATENT DOCUMENTS

| | | | | |
|---|---|---|---|---|
| 2017/0204700 | A1 | 7/2017 | Hughes et al. | |
| 2018/0038221 | A1 | 2/2018 | Hughes et al. | |
| 2018/0238137 | A1 | 8/2018 | Hughes et al. | |
| 2018/0238142 | A1 | 8/2018 | Hughes et al. | |
| 2020/0095855 | A1* | 3/2020 | Hughes | E21B 34/142 |

* cited by examiner

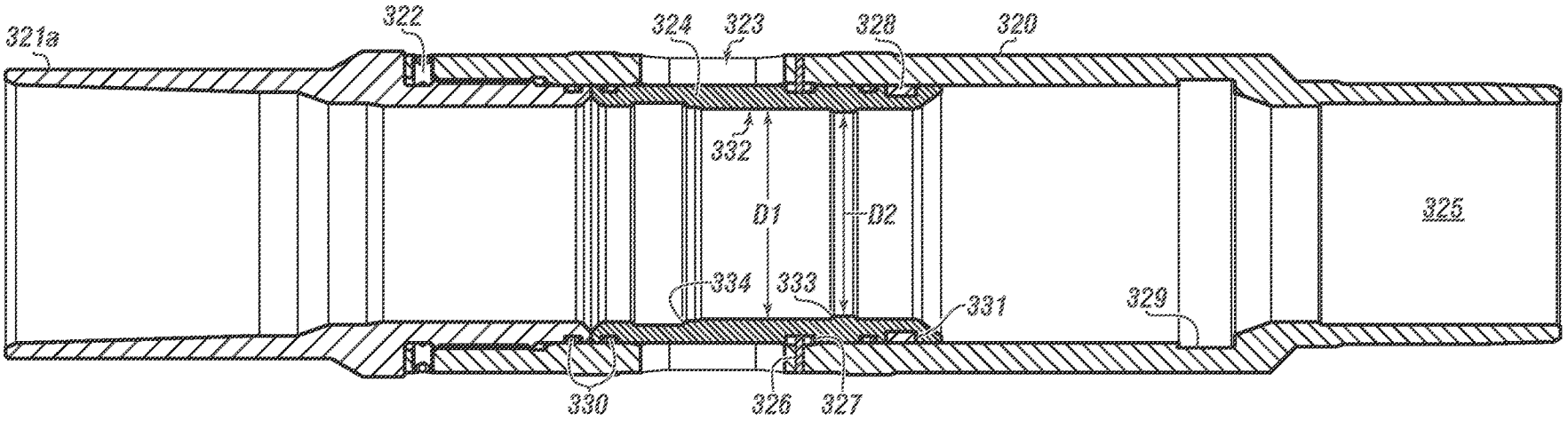
FIGURE 3A
FIGURE 3B
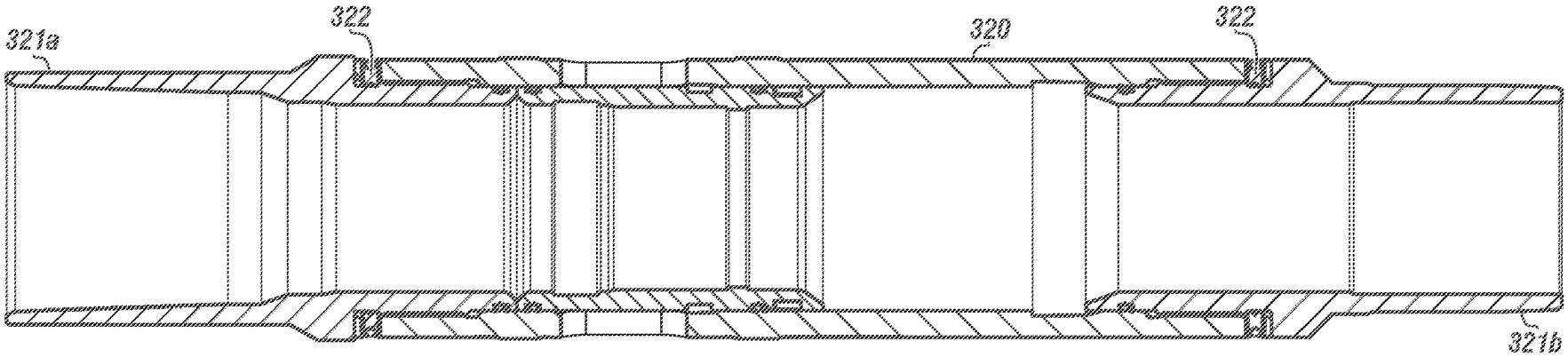

F

SYSTEMS AND METHODS FOR MULTI-STAGE FRACTURING

STATEMENT REGARDING FEDERALLY SPONSORED RESEARCH OR DEVELOPMENT

Not applicable.

BACKGROUND

Field of the Disclosure

This disclosure generally relates to downhole tools and related systems and methods used in oil and gas wellbores. More specifically, the disclosure relates to a downhole system and tool(s) that may be run into a wellbore and useable for wellbore isolation, and methods pertaining to the same. In particular embodiments, the disclosure presents a system and method for stimulating a formation in multiple stages while providing an operator with flexibility in the stages that are to be stimulated or isolated from stimulation. In still other embodiments, a single plugging device may be used to activate a plurality of frac sleeves.

Background of the Disclosure

An oil or gas well includes a wellbore extending into a subterranean formation at some depth below a surface (e.g., Earth's surface), and is usually lined with a tubular, such as casing, to add strength to the well. Many commercially viable hydrocarbon sources are found in "tight" reservoirs, which means the target hydrocarbon product may not be easily extracted. The surrounding formation (e.g., shale) to these reservoirs typically has low permeability, and it is uneconomical to produce the hydrocarbons (i.e., gas, oil, etc.) in commercial quantities from this formation without the use of drilling accompanied with fracing operations.

Fracing now has a significant presence in the industry, and is commonly understood to include the use of some type of plug set in the wellbore below or beyond the respective target zone, followed by pumping or injecting high pressure frac fluid into the zone. For economic reasons, fracing (and any associated or peripheral operation) is now ultra-competitive, and in order to stay competitive innovation is paramount. One form of a frac operation may be a 'plug and perf' type, such as described or otherwise disclosed in U.S. Pat. No. 8,955,605, incorporated by reference herein in its entirety for all purposes.

In this type of operation, the tubestring does not have any openings through its sidewalls; instead, perforations are created by so-called perforation guns which discharge shaped charges through the tubestring and, if present, adjacent cement. The zone near the perf is then hydraulically fractured, followed by the setting of a new plug, re-perf, etc. That process is repeated until all zones in the well are fractured.

The plug and perf method is widely practiced, but it has a primary drawback of being time consuming. Other problems include: plug defects (such as slippage, presets, hang ups, and drillout issues), perf erosion, wireline and drillout crew resource required, and the plug run times associated with wireline, especially during single well operations.

Multistage fracturing is another form of frac operation that also enjoys popularity. In this type of frac operation, multi-stage wells require the stimulation and production of one or more zones of a formation. Conventionally, a liner, casing, or other type of tubestring is downhole, in which the tubestring includes one or more downhole frac valves (any may further include, but not be limited to, ported sleeves or collars) at spaced intervals along the wellbore.

Such frac valves typically include a cylindrical housing that may be threaded into and forms a part of the tubestring. The housing defines a flowbore through which fluids may flow. Ports are provided in the housing (e.g., sidewall) that may be opened by actuating a sliding sleeve. Once opened, fluids are able to flow through the ports and fracture the formation in the vicinity of the valve, and vice versa.

The location of the frac valves is commonly set to align with the formation zones to be stimulated or produced. The valves must be manipulated in order to be opened or closed as required. In the case of multistage fracking, multiple frac valves are used in a sequential order to frac sections of the formation, typically starting at a toe end of the wellbore and moving progressively towards a heel end of the wellbore. It is crucial that the frac valves be triggered to open in the desired order and that they do not open earlier than desired.

By way of example, FIG. 1 shows a conventional multi-stage production system using a plurality of frac valves 102. The frac valves 102 may be incorporated into a tubular 104 disposed in a typical wellbore 106 formed in a subterranean formation 110.

The wellbore 106 may be serviced by a derrick 103 and various other surface equipment (not shown). The wellbore 106 may be provided with a casing string 105, which may be part of tubular 104. The tubular 104 may include or be coupled with the casing string 105 via a hanger 101. It will be noted that part of the wellbore 106, and part of the wellbore may be generally horizontal. The tubular 104 may be cemented in place via cement 107.

A typical frac operation will generally proceed from the lowermost zone in the wellbore (sometimes the 'toe') to the uppermost zone (sometimes the 'heel'). FIG. 1 shows fractures 109 have been established in the vicinity of the frac valves 102 in zones near the toe 111. Additional uphole zones in the wellbore 106 may be fracked in succession until all stages of the frac operation have been completed, and fractures in all desired zones have been established.

In some instances (not viewable here), the tubular 104 is arranged with valves having seats of increasing inside diameter progressing from toe to heel. The valves are manipulated by pumping multiple plug devices, such as balls, plugs or darts, each having sequentially increasing outside diameters, down the tubestring. The first plug, having the smallest outside diameter passes through all frac valves until it seats on the first (or furthermost) valve seat, having the smallest inside diameter.

When a plug lands on a respective seat, fluid pressure uphole of the plug urges the plug downhole, which causes it to induce analogous movement of a sleeve of the valve downhole, which exposes the ports of the frac valve. In this arrangement, each valve must be uniquely built with a specific seat size and must be arranged on the tubestring in a specific order. Additionally, a stock of plug devices of all sizes of diameter must always be maintained to be able to manipulate all of the unique valve seats.

In other cases, opening of the frac valve is achieved by running a bottom hole assembly, also known as an intervention tool, down on a workstring through the tubestring, locating in the frac valves to be manipulated and manipulating the valve by any number of means including use of mechanical force on the intervention tool, or by hydraulic pressure. However, the use of an intervention tool is not always desirable; the workstring on which the intervention tool is run presents a flow restriction within the tubestring and prevents the full bore fluid flow required within the tubestring to achieve the needed stimulation pressure.

Despite popularity, multistage fracturing with frac valves has its own share of problems. Sleeve design problems include: limited number of stages per well, the need for coiled tubing in the hole during operations, and the need for drilling out seats post operations. Many conventional systems utilize a ball drop process that requires a high amount of precision not always achievable. Modern designs that attempt to solve these issues are overly complex, and require a wide array of varied tools (which corresponds to high manufacture costs).

A need exists for simple but robust system in which multiple frac valves (one or more of which may be identical) may be run downhole, and may be be opened in any sequence by a single device.

There is a need for a frac valve system that does not require the use of an intervention tool or of unique frac valves and dedicated balls or plugs. There is a need for a system that may be operable to open one or more frac valves in any order desired, and may provide for repeated opening and closing one or more frac valves within a tubestring for varying purposes.

The ability to save cost on materials and/or operational time (and those saving operational costs) leads to considerable competition in the marketplace. Achieving any ability to save time, or ultimately cost, leads to an immediate competitive advantage.

Accordingly, there are needs in the art for novel systems and methods for isolating wellbores in a fast, viable, and economical fashion.

SUMMARY

Embodiments of the disclosure pertain to a downhole system for stimulating one or more stages of a downhole wellbore. The system may include one or more frac valves arranged on tubular; any of such frac valves presenting an identical inside profile to another, and any of which may be openable for providing fluid communication between internal and external of the tubular. There may be an at least one dart deployable into the tubular, and being adjustable to pass through one or more frac valves without opening one or more frac valves, and yet may be able to engage and open one or more other frac valves.

Other embodiments of the disclosure pertain to a system for stimulating a subterranean formation that may include a wellbore formed within the subterranean formation; and a tubular disposed within the wellbore.

Embodiments of the disclosure pertain to a downhole system for multistage fracturing a subterranean formation that may include one or more of: a first cluster of valves; a second cluster of valves downhole of the first cluster; and a third cluster of valves downhole from the second cluster.

There may be a plugging device having a plug body. The plug body may have a distal end, a proximate end, and an outer surface. There may be a plurality of grooves disposed on the outer surface. The plugging device may have an index sleeve movingly disposed on the outer surface. The index sleeve may have an upper collet end and a lower collet end configured to engage the plurality of grooves.

In assembly, the index sleeve may be set in an initial position corresponding to the desired target frac valve. The index sleeve may be in the initial position prior to entering the first cluster of valves. During engagement with a frac valve of the first cluster, the index sleeve may be incremented from the distal end toward the proximate end one groove of the plurality of grooves. The index sleeve may be moved to a first armed position by one of the second cluster of valves. The plugging device may not open any valves of the first and second cluster of valves, but opens every valve of the third cluster of valves.

Each of the first cluster of valves, the second cluster of valves, and the third cluster of valves may include a flex valve. Each flex valve may include a respective flex sleeve configured with rigid portion and a flexible portion. The flexible portion may include a plurality of fingers. In aspects, the index sleeve may not be able to engage the plurality of fingers unless it is in the first armed position or a final armed position.

The outer surface of the plugging device may include an outermost ridge and an extended rib. The first armed position may include the lower collet end disposed on the extended rib. The final armed position may include the lower collet end moved uphole and off the extended rib, and the upper collet end engaged with the outermost ridge.

Each of the first cluster of valves, the second cluster of valves, and the third cluster of valves each may include a frac valve comprising a respective solid sleeve configured with an inner sleeve shoulder.

The plugging device may engage, but need not open, any of the frac valves of the first and second cluster of valves. The plugging device may engage and open the frac valve of the third cluster of valves.

The plugging device may include any of: a lower sleeve engaged with the distal end; an upper sleeve engaged with the proximate end; and/or a removable plug sealingly disposed within the upper sleeve.

Any groove of the plurality of grooves of embodiments herein may be characterized as having a respective trough and crest. One or more crests may have an extended plateau.

The outer surface may include an extended rib having an outer diameter larger than any surface of the plurality of grooves. The outer surface may include an outermost ridge having an outer ridge diameter larger than the outer diameter of the extended rib.

The plugging device may include an upper fin, which may be engaged with the upper sleeve. The upper fin may be configured with a catch shoulder configured to hold the removable plug in sealing engagement with the upper sleeve.

Other embodiments pertain to a plugging device having a plug body. The plug body may have a distal end, a proximate end, and an outer surface. There may be a plurality of grooves disposed on the outer surface. The plugging device may have an index sleeve movingly disposed on the outer surface. The index sleeve may have an upper collet end and a lower collet end configured to engage the plurality of grooves.

Still other embodiments pertain to a frac valve—plugging device assembly. The assembly may include the plugging device engaged with the frac valve.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein:

FIG. 3A shows a longitudinal side cross-sectional view of a solid sleeve frac valve, according to embodiments of the disclosure;

FIG. 3B shows a longitudinal side cross-sectional view of a solid sleeve frac valve having a lower end fitting, according to embodiments of the disclosure;

FIG. 6N shows a zoom in longitudinal side cross-sectional view of the plugging device and the another frac valve of FIG. 6M, with the index sleeve further incremented, according to embodiments of the disclosure;

DETAILED DESCRIPTION

Figure 1:
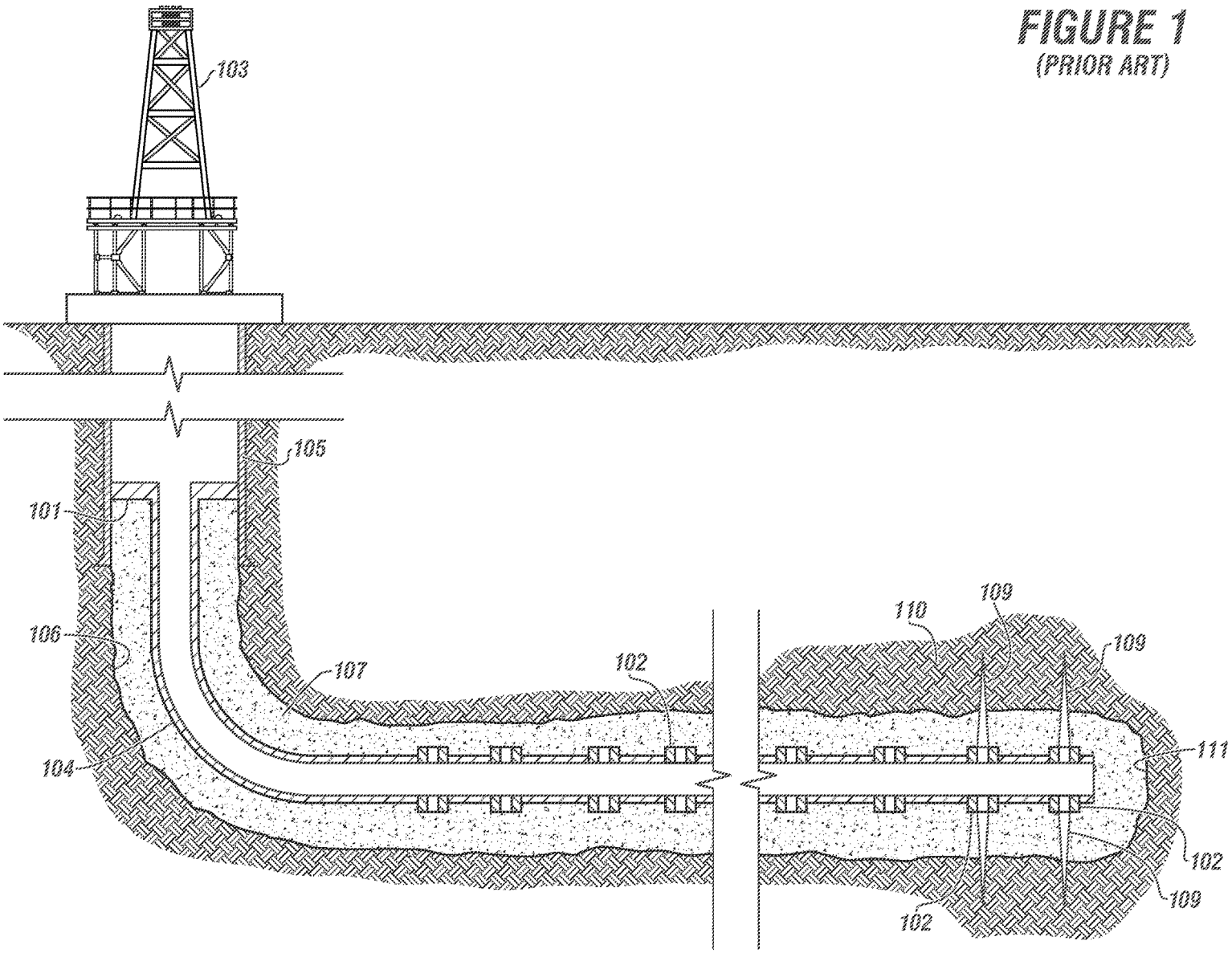
FIGURE 1 (PRIOR ART)
FIG. 1 shows a side view of a process diagram of a conventional multistage fracture system.

Herein disclosed are novel apparatuses, assemblies, systems, and methods that pertain to and are usable for wellbore operations, and aspects (including components) related thereto, the details of which are described herein.

Embodiments of the present disclosure are described in detail in a non-limiting manner with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," "right", "left", "down", etc., are used for convenience and to refer to general direction and/or orientation, and are only intended for illustrative purposes only, and not to limit the disclosure, unless expressly indicated otherwise.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components that may be new, used, and/or retrofitted.

Various equipment may be in fluid communication directly or indirectly with other equipment. Fluid communication may occur via one or more transfer lines and respective connectors, couplings, valving, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, temperature, pressure, distance, melt index, etc., is from 100 to 1,000, it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Others may be implied or inferred.

Embodiments herein may be described at the macro level, especially from an ornamental or visual appearance. Thus, a dimension, such as length, may be described as having a certain numerical unit, albeit with or without attribution of a particular significant figure. One of skill in the art would appreciate that the dimension of "2 centimeters" may not be exactly 2 centimeters, and that at the micro-level may deviate. Similarly, reference to a "uniform" dimension, such as thickness, need not refer to completely, exactly uniform. Thus, a uniform or equal thickness of "1 millimeter" may have discernable variation at the micro-level within a certain tolerance (e.g., 0.001 millimeter) related to imprecision in measuring and fabrication.

Terms

The term "connected" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, multi-phase, etc. and is not limited to any particular type of fluid such as hydrocarbons.

The term "fluid connection", "fluid communication," "fluidly communicable," and the like, as used herein may refer to two or more components, systems, etc. being coupled whereby fluid from one may flow or otherwise be transferrable to the other. The coupling may be direct or indirect. For example, valves, flow meters, pumps, mixing tanks, holding tanks, tubulars, separation systems, and the like may be disposed between two or more components that are in fluid communication.

The term "pipe", "conduit", "line", "tubular", or the like as used herein may refer to any fluid transmission means, and may be tubular in nature.

The term "tubestring" or the like as used herein may refer to a tubular (or other shape) that may be run into a wellbore. The tubestring may be casing, a liner, production tubing, combinations, and so forth. A tubestring may be multiple pipes (and the like) coupled together.

The term "workstring" as used herein may refer to a tubular (or other shape) that is operable to provide some kind of action, such as drilling, running a tool, or any other kind of downhole action, and combinations thereof.

The term "frac operation" as used herein may refer to fractionation of a downhole well that has already been drilled. 'Frac operation' can also be referred to and interchangeable with the terms fractionation, hydrofracturing, hydrofracking, fracking, fracing, frack, frac, etc. A frac operation can be land or water based.

The term "mounted" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth.

The term "machined" can refer to a computer numerical control (CNC) process whereby a robot or machinist runs computer-operated equipment to create machine parts, tools and the like.

The term "parallel" as used herein may refer to any surface or shape that may have a reference plane lying in the same direction as that of another. It should be understood that parallel need not refer to exact mathematical precision, but instead be contemplated as visual appearance to the naked eye.

Figure 2A:
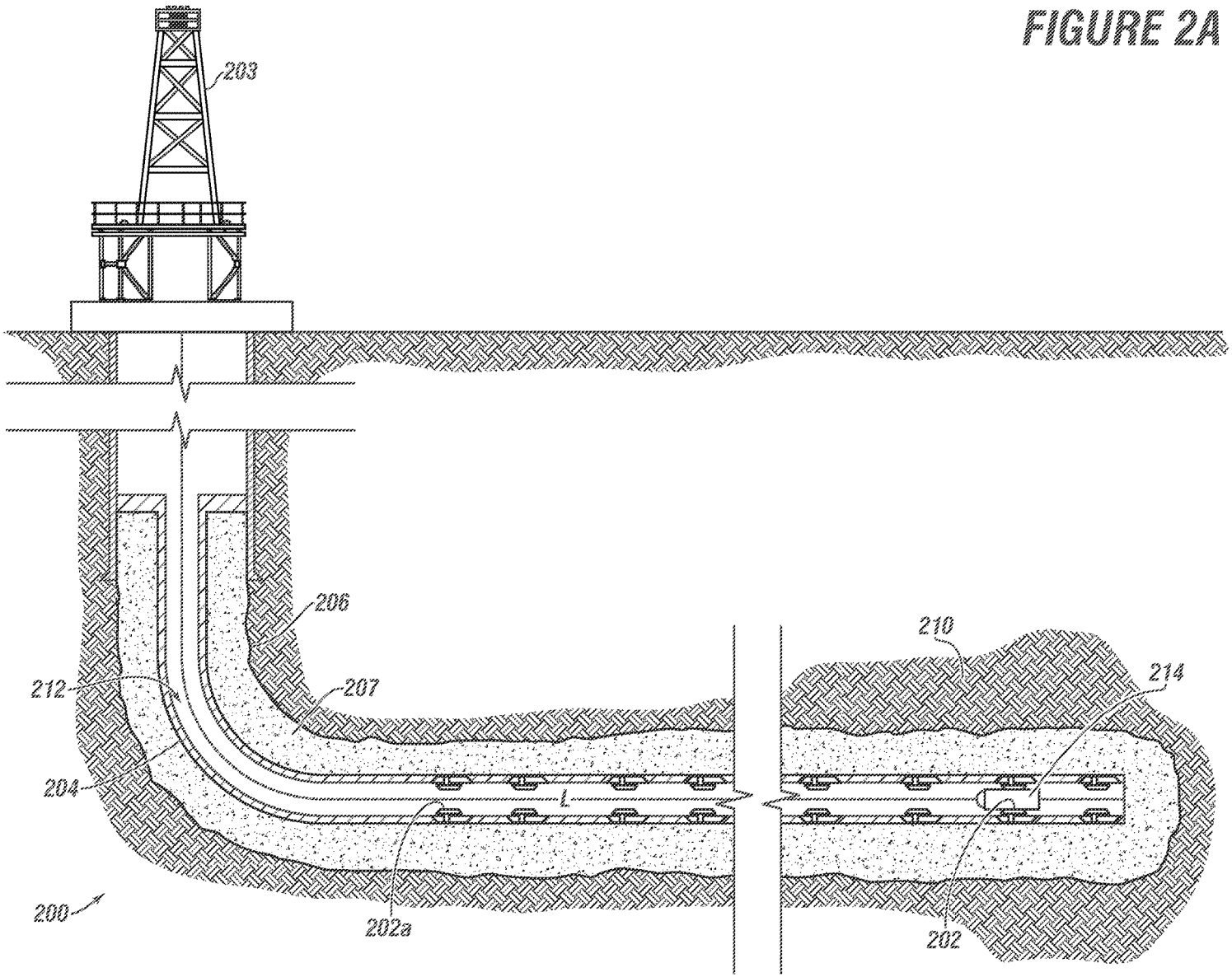
FIG. 2A shows a side view of a multistage fracture system with a cemented tubular having one or more valve clusters according to embodiments of the disclosure.
Figure 2B:
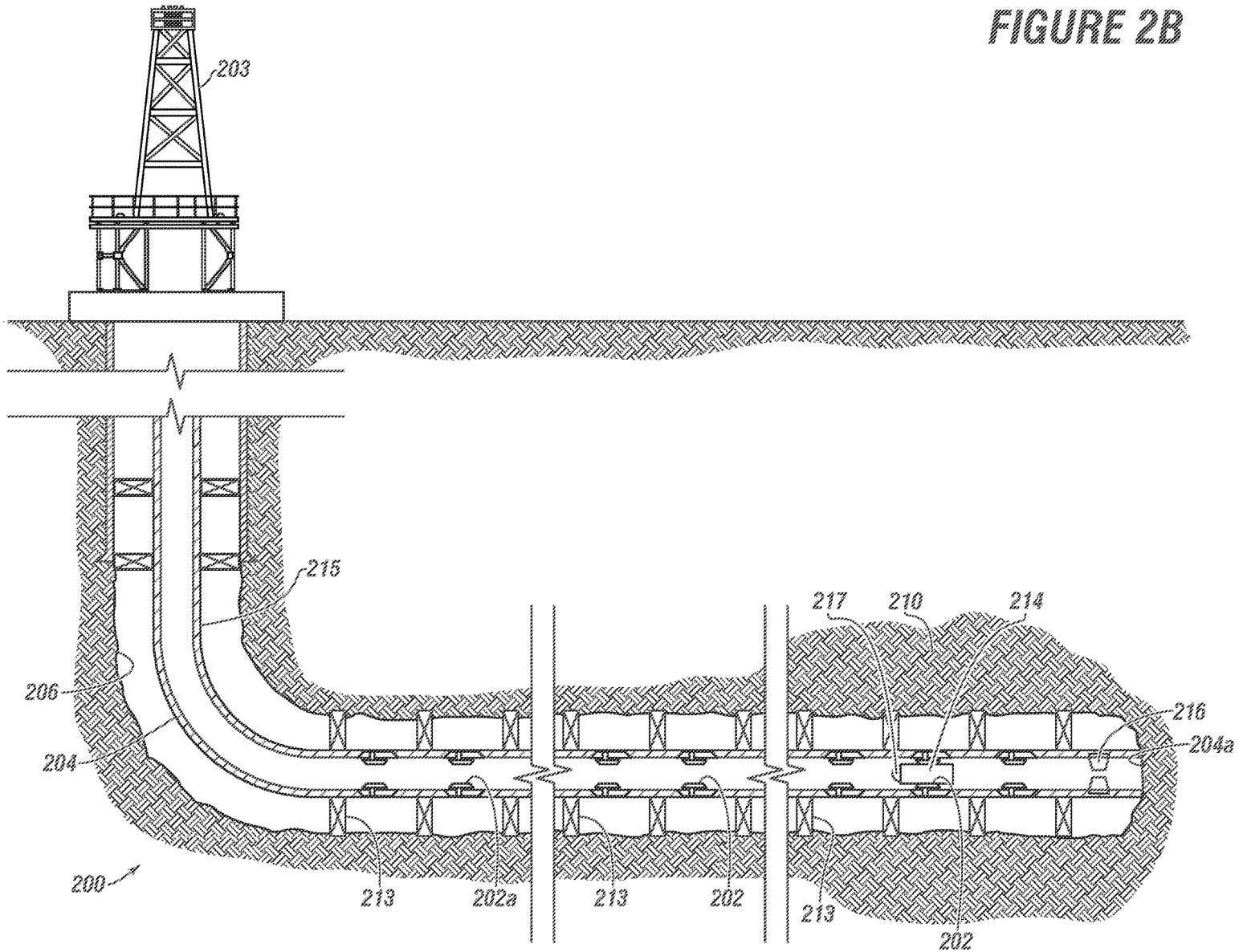
FIG. 2B shows a side view of a multistage fracture system with a packer-supported tubular having one or more valve clusters according to embodiments of the disclosure.

Referring now to FIGS. 2A and 2B together, a side process view of multistage completion system having a cemented tubular, and a multistage completion system having a packer supported tubular, each having a plurality of frac valves, in accordance with embodiments disclosed herein, are shown.

FIGS. 2A and 2B may be contemplated as system 200 being generally similar, with the exception that FIG. 2A illustrates use of cement 207 for the support of a tubular 204, whereas FIG. 2B illustrates use of one or more packers 213. As such, reference may be made to FIGS. 2A and 2B interchangeably in a general sense, unless described or referenced otherwise. That said, embodiments herein are not meant to be limited, and may include the scenario where the wellbore 206 may be both cemented and having packers 213. The packers 213 may be open hole packers.

The wellbore 206 may be an open hole, a cased hole, or a hybrid thereof, with a portion cased and a portion open. The wellbore 206 may be vertical, horizontal, deviated or of any orientation. Embodiments herein may pertain to off-shore or onshore operations. The wellbore 206 may be serviced by a derrick 203 and various other surface equipment (pumps, production string, drill string, etc.—not shown).

Components of system 200 may be operable separately or together to provide fluid communication between an inside 212 of the tubular 204 and outside thereof, such as to an annulus 215 or to a surrounding surface 210. The surrounding surface 210 may be (at least a portion of) a subterranean formation.

One or more frac valves 202 may be installed at any point along a length L of the tubular 204. Frac valves 202 may be installed onto or otherwise with the tubular 204, and along the length L at strategic of predetermined points. As the tubular 204 is disposed within the wellbore 206, sections of the tubular 204 may be coupled together, such as when stands of pipe have box and pin ends that are engaged. Valves 202 may be installed between joints of the tubular 204. A lower toe valve 216 may be placed near the lower, or toe end 204*a* of the tubular 204.

A plugging device 214 may be used to shift a sleeve of the frac valve 202 from a first position to a second position. The first position may have ports of the valve closed by the sleeve, and a second position may have ports of the valve opened as the sleeve is shifted. A ball 217 may be used with or be part of the plugging device 214. In embodiments the plugging device 214 may be a dart configured with a ball seat for the ball 217 to seat thereon.

Embodiments herein may entail use of three main components. The aforementioned plugging device 214 and frac valve 202. Alas, various types and configurations of the plugging device 214 and frac valve 202 may be utilized. For example, there may be a first configuration of a frac valve 202 having a solid sleeve. There may be a second configuration of a frac valve 202*a* having a flex sleeve (or collet sleeve). To provide the reader with ease in distinguishing, the first configuration may simply be referred to as frac valve, whereas the second configuration may be referred to as a 'flex valve' (or 'flex frac valve', 'flex sleeve valve, and the like).

The plugging device 214 may be configured to engage either type or both of the frac valve 202 and the flex valve 202*a*. A plurality of valves 202, 202*a* may be referred to as a 'cluster' of valves (or 'valve cluster'). The plugging device 214 may be configured to engage and open a frac valve 202, and also engage and open a flex valve 202*a*. A valve cluster may include at least one frac valve and one flex valve. There may be a plurality of valve clusters. The number of clusters may coincide to the number of stages for completion. For example, if desired to fracture one stage, one cluster of valves may be utilized.

In embodiments, there may be a first frac valve fluster having a first frac valve and first flex valve, and a second valve cluster having a second frac valve and a second flex valve. The plugging device may be configured to engage, but not open the first frac valve, pass through the first flex valve, and engage and open the second frac valve. Other valves 202, 202*a* may be therebetween.

The plurality of valves 202, 202*a* may be installed on, and/or as part of, the tubular 204, and spaced apart as desired or otherwise mentioned herein. The plugging device 214 may be deployed into the tubular 204, and pumped down therein towards the valves 202, 202*a*. Although one or more plugging devices 214 may be utilized, it is within the scope of the disclosure that embodiments herein need only utilize a single plugging device 214 to open multiple valves. The number of plugging devices 214 desired or used may relate to the number of stages of the formation 210 to be stimulated. For example, a first plugging device may be used to open all the valves 202, 202*a* of a first or lower cluster, while a second plugging device may be used to open all the valves 202, 202*a* of a second or upper cluster.

The valves of any cluster need not be identical. With that said, valves 202, 202*a* may have identical (within high tolerance) diameter seat sizes. The frac valves 202 do not need to be installed in any particular order. However, it is within the scope of the disclosure that two or more valves 202, 202*a* may have similar or identical: (within reasonable machine tolerance) end connections (fittings), outside diameter (O.D.), and inside profile. The frac valve 202 may have a valve sleeve (or seat) of the same profile as any other frac valve 202. The sleeve may be shiftable sleeve to expose ports in order to facilitate or allow for fluid communication between an inside of the valve 202 (or tubular 204) and formation 210 surrounding it.

The opening pressure required to shift the sleeve may be adjustable via adjustment or configuration of one or more retainer members. The retainer member may be configured to hold the sleeve in an initial or first closed position. In aspects, any valve 202, 202*a* may be configured with the same opening pressure or force requirement to shift a respective sleeve.

Referring now to FIGS. 3A and 3B together, a longitudinal side cross-sectional view a frac valve and a longitudinal side cross-sectional view a frac valve having a lower end fitting, in accordance with embodiments disclosed herein, are shown.

The frac valve 302 may have a main valve body 320. The frac valve 302 may include one or more end fittings 321*a* and 321*b* (such as shown on 3B), which may be on either or each end of the main body 320. As such, the end fittings 321*a*, 321*b* may be integral with the main body 320, or be coupled therewith, such as threadingly, via the use of one or more respective securing members 322 (e.g., pins, set screws, or the like), or combinations thereof. The use of separate end fittings 321*a*, 321*b* may allow for ease of manufacture of the main body 320, and at the same time allow for the frac valve 302 to be configured for coupling with varied joints. The end fittings 321*a*, 321*b* may be configured for coupling respective ends (e.g., one for box end, other for pin end, etc.) of the tubular (204) joints.

The main body 320 may have an inner bore 325, which may be at least partially open through an entire body length of the valve 302. There may be a valve sleeve (or seat) 324 disposed therein. The valve sleeve 324 may be shiftable. The valve sleeve 324 may be shiftable from a first position to a second position. The first position of the sleeve 324 may be where the ports 323 are closed (e.g., blocked) by the sleeve 324. The second position of the sleeve 324 may be any position thereof whereby the sleeve 324 no longer blocks, at least partially, the ports 323. The second position may include or be related to the breakage at least one retainer member 326. The second position of the sleeve 324 may be a fully open position, which may coincide with the ports 323 being completely unblocked. The second position may include a bias member 328 expanded into a receptacle 329.

The first position may correspond to a lack of communication between the bore 325 and the external side of the valve 302. The second position may correspond to the ability to have fluid communication between the bore 325 and the external side of the valve 302.

The valve sleeve 324 may be held temporarily in place in the first position via one or more retainer members 326. The main body 320 may have a retainer member receptable 327 for the respective member 326 to engage therewith. The retainer member 326 may be a shear screw, pin, etc. As such, the amount of force needed to move the valve sleeve 324 may be predetermined. Once the member(s) 326 breaks, the valve sleeve 324 may freely move. The valve sleeve 324 may also be sealingly engaged with the main body 320 via one or more seals, o-rings, etc. 330.

The valve sleeve 324 may sealingly and slidingly move downward until a sleeve groove 331 may be laterally proximate a main body receptacle 329. The sleeve groove 331 may be circumferential around the outside surface of the sleeve 324. In a comparable manner, the main body receptacle 329 may be circumferential around the inside surface of the main body 320. A biased member, such as a snap ring, 328 may be disposed within the sleeve groove 331. As one of skill would appreciate, as the groove 331 and the receptacle 329 align, the bias member 328 may expand outward, which may then provide an added shoulder or stop for the sleeve 324. The expansion of the bias member 328 into the receptacle 329 may help keep the valve sleeve 324 in place without any further sliding upward or downward.

The sleeve 324 may have an inner sleeve surface 332, which may be defined by a continuous sleeve inner diameter D1. The inner sleeve surface 332 may have an annular sleeve shoulder (or rib, protrusion, catch, seat, etc.) 333, which may be defined with an inner(most) shoulder having a diameter D2. In embodiments, D1 may be greater than D2. The sleeve shoulder 333 may be configured for part of a plugging device (e.g., 214) to engage therewith. In the event the sleeve 324 is shifted, the plugging device may be configured to disengage with the shoulder 333.

An upper end of the inner sleeve surface 332 may form a sleeve seal shoulder 334. The plugging device may also be configured to engage the sleeve seal shoulder 334.

Figure 4:
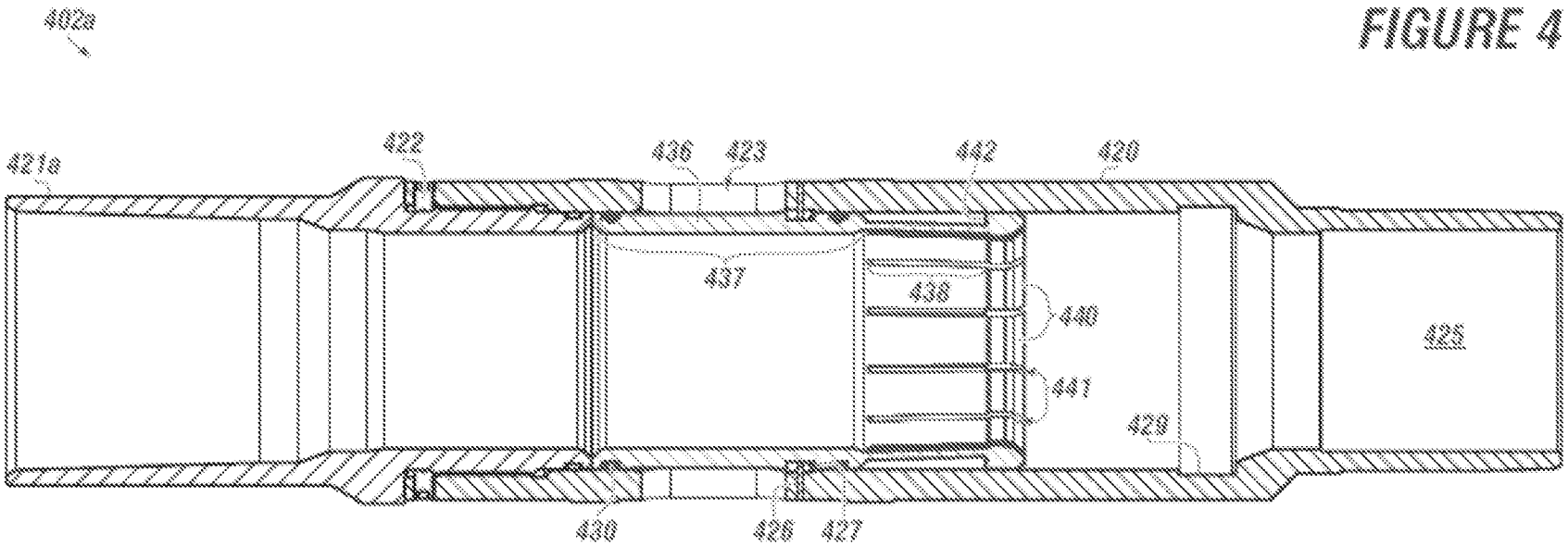
FIG. 4 shows a longitudinal side cross-sectional view of a flex sleeve frac valve, according to embodiments of the disclosure.

Referring now to FIG. 4, a longitudinal side cross-sectional view of a flex valve, in accordance with embodiments disclosed herein, are shown.

By way of comparing FIG. 3 and FIG. 4, one of ordinary skill would appreciate the flex valve 402*a* may be generally similar to the frac valve 302, and in some respect may even be identical. This may useful to help offset problems or expense attributable to machining many varied parts, versus just a few. Still, there may be differences, such as, for example, the presence of a flex sleeve 436. Other differences are within the scope of the disclosure.

The flex valve 402*a* may be run, positioned, and opened as described herein and in other embodiments (such as in system 200, and so forth), and as otherwise understood to one of skill in the art. The flex valve 402*a* may be comparable or identical in aspects, function, operation, components, etc. as that of other valve embodiments disclosed herein. Similarities may not be discussed for the sake of brevity. The flex valve 402*a* may be part of a valve-plugging device assembly.

For the sake of ease to the reader, components of the flex valve 402*a* may be described in a manner comparable to that of the frac valve 302. As such, the flex valve 402*a* may have a main flex valve body 420. The flex valve 402 may include one or more end fittings 421*a* (or comparable to 321*b* on FIG. 3B), which may be on either or each end of the main flex body 420*a*. As such, the end fittings may be integral with the main body 420, or be coupled therewith, such as threadingly, or via the use of one or more respective securing members 422 (e.g., pins, set screws, or the like). The end fittings 421*a*, etc. may be configured for coupling respective ends (e.g., one for box end, other for pin end, etc.) of the tubular (204) joints.

The main body 420 may have an inner flex bore 425, which may be at least partially open through an entire body length of the valve 402*a*. There may be a flex valve sleeve (or seat) 424 disposed therein. The flex valve sleeve 424 may have a rigid portion 437 and a flex portion 438, the flex portion 438 essentially a plurality of fingers 440 (with respective slots 441 therebetween) that may be flexible. As shown in FIG. 4, in an assembled (run-in, first, unactivated, etc.) configuration, the fingers 440 may be in a flexed inward position.

The flex valve sleeve 424 may be shiftable. The valve sleeve 424 may be shiftable from a first position shown in FIG. 4 to a second position (see FIG. 6T). The first position of the sleeve 424 may be where the flex ports 423 are closed (e.g., blocked) by the sleeve 424. The second position of the sleeve 424 may be any position thereof whereby the sleeve 424 no longer blocks, at least partially, the ports 423. The second position of the sleeve 424 may be a fully open position, which may coincide with the ports 423 being completely unblocked. The second position may include ends 442 of fingers 440 flexed radially outward into a flex body receptacle 429. The flex body receptacle 429 may be an inner annular grove within the body 420.

The first position may correspond to a lack of communication between the bore 425 and the external side of the flex valve 402*a*. The second position may correspond to the ability to have fluid communication between the bore 425 and the external side of the flex valve 402*a*.

The flex valve sleeve 424 may be held temporarily in place in the first position via one or more retainer members 426. The main body 420 may have a retainer member receptable 427 for the respective member 426 to engage therewith. The retainer member 426 may be a shear screw, pin, etc. As such, the amount of force needed to move the flex valve sleeve 424 may be predetermined. Once the member(s) 426 breaks, the flex valve sleeve 424 may freely move. The flex valve sleeve 424 may also be sealingly engaged with the main body 420 via one or more seals, o-rings, etc. 430.

As one of skill would appreciate, as end(s) 442 of respective fingers 440 and the receptacle 429 align, the ends 442 may expand outward. The expansion of the ends 442 into the receptacle 429 may help keep the flex valve sleeve 424 in place without any further sliding upward or downward (and thus the valve 402*a* may be opened, and kept open).

The sleeve 424 may have an inner sleeve surface, which may be defined by a continuous sleeve inner diameter. The inner sleeve surface may be configured for part of a plugging device (e.g., 214) to engage therewith. In embodiments, an inner edge of finger ends 442 may be configured for part of the plugging device to engage therewith. In the event the sleeve 424 is shifted, the plugging device may be configured to disengage therefrom.

Referring now to FIGS. 5A, 5B, 5C, and 5D, an isometric component breakout view, an isometric assembled view, a longitudinal side cross-sectional view, and a longitudinal side cross-sectional view a main body configured with a grooved outer surface profile, respectively, of a plugging device, in accordance with embodiments disclosed herein, are shown.

As would be apparent while the valves described herein may be stationary as part of a tubular (204), a plugging device 514 may be disposed within the tubular and run downhole therethrough. A valve (e.g., 202, 302, 402*a*, etc.) of the present disclosure may have the plugging device 514 engaged therewith, and thus forming a valve-plugging device assembly.

The plugging device 514 may be run, positioned, and operated as described herein and in other embodiments (such as in system 200, and so forth), and as otherwise understood to one of skill in the art. The plugging device 514 may be comparable or identical in aspects, function, operation, components, etc. as that of other embodiments disclosed herein. Similarities may not be discussed for the sake of brevity.

FIGS. 5A-5D together show the plugging device 514 may have a main plug body 550. Although not limited to any particular shape, the main plug body 550 may be a generally cylindrical shape with a plug bore 553. The bore 553 may extend through the entire plug body 550 from a distal end 554 to a proximate end 555. An inner diameter Db of the bore 553 may be any size as desired, and may be suitable for the flow of fluids therethrough.

Although a plug inner surface may be generally smooth, an outer plug surface 552 may be configured with one or more undulations or ring grooves 551. The plurality of grooves 551 need not helically wind like a thread, but may instead be circumferential on a lateral, such that an individual groove 551 starts and ends with itself. Any groove 551 of the plugging device 514 may be contemplated to have a respective crest C adjacent a trough T. The predominant portion of grooves 551 may have the crest C with outer diameter D4 and trough T with outer diameter D3; however, not all of the structure or grooves on the outer plug surface 552 are the same or uniform, with particular differences described herein.

For example, the outer surface 552 may have an extended rib 556 having an outer diameter D5. As shown, the outer diameter D5 may be larger than each of D3 and D4. The difference in size effects the relationship of an index sleeve 557 that may be disposed around the body 550, and may be engaged with the outer surface 552. As such, the index sleeve 557 may be configured to generally accommodate whatever the shape of the body 550 may be.

The index sleeve 557 may be annular in nature with an upper collet 558 and lower collet 559 separated by a central band 557*a*, the sleeve 557 configured to movably engage the body 550. As one of skill would appreciate, the upper collet 558 and lower collet 559 may be contemplated as a plurality of respective fingers. The upper collet 558 and the lower collet 559 may be biased (e.g., radially) inward. So even though the index sleeve 557 may be movingly engaged with the body 550, there may be some amount of resistance that mitigates against completely free movement. This may be from, for example, a coefficient of friction between the surfaces of the grooves 551 and the respective upper and lower collet ends 560, 561 (the 'ends' being the ends of respective collet fingers).

The interaction between the collet ends 560, 561 with the grooves may have an alternating configuration. For example, an inner upper collet end surface 562 may be engaged with the trough of one of the grooves, while at the same time, an inner lower collet end surface 563 may be engaged with the crest of another of one of the grooves. How the sleeve 557 indexes (counts) or moves along the surface 552 may be determined or otherwise dependent upon how the surfaces 562, 563 interact therewith. As described herein, this may be the result of how the plugging device 514 interacts with the valves (202, 302*a*, etc.).

While not meant to be limited, embodiments herein pertain to how in operation the index sleeve 557 may only move in one direction, such as from the distal end 554 toward the proximate end 555. For example, when the index sleeve 557 comes into contact with a shoulder surface of a frac sleeve, the surface may be resilient enough to bump the lower collet end 561 into an adjacent trough, and simultaneously the upper collet end 560 to an adjacent crest.

This provides adequate clearance for the plugging device 514 to resume passing through the sleeve until the upper collet end 560 hits the surface. As the device 514 contacts the surface, the upper collet end 560 may then be bumped into a next adjacent trough, and the lower collet end 561 bumped to a next adjacent crest. This may be a 'count', 'cycle', 'increment' 'index', etc. of the index sleeve 557. The plugging device 514 may then resume passage all the way through the sleeve, and proceed to a next valve sleeve, where the count sequence may repeat, albeit with the sleeve 557 indexed a single count.

The plugging device 514 may be configured to count any desired amount of frac sleeves (of respective valves) simply by extending the length of the device 514 and adding the desired amount of grooves 551. In embodiments there may be a range of an at least one valve to at least 1,000 valves. The range may be about 10 valves to about 100 valves. It is worth noting that the plugging device 514 may be configured to count a first frac valve, but pass through a next or second valve without counting it (i.e., without indexing [moving] the sleeve 557).

The distal end 554 may have a lower sleeve 564 engaged therewith. The engagement with the distal end 554 may be threadingly. The lower sleeve 564 may also have a lower cup or support fin 565 engaged therewith. The engagement between the lower sleeve 564 and the lower support fin 565 may be threadingly, bonded, glued, etc. In assembly of the plugging device 514, the lower support fin 565 may first be coupled with the lower sleeve 564, and then the lower sleeve (with fin 565) may be engaged with the body 550.

While the lower sleeve 564 may be made of a rigid material, such as metal, the support fin 565 may be made of a pliable material, such as rubber. The lower sleeve 564 and support fin 565 may help with alignment as the plugging device 514 moves through a frac valve. The lower sleeve 564 may have a lower sleeve seat 566. In some embodiments, a ball (not viewable here) downhole of the plugging device 514 may flow upward toward the device. The ball may seat against the seat 566. This may happen, for example, if the ball is blown from its own device, or may not properly dissolve. To prevent inadvertent blockage of the bore 553, there may be one or more ruts 567 formed in the lower sleeve. Thus, if a ball is seated thereagainst, fluid may flow around the ball and through the bore 553 by way of the ruts 567.

The proximate end 555 may have an upper sleeve 568 engaged therewith. The engagement with the proximate end 555 may be threadingly. The upper sleeve 568 may also have an upper cup or support fin 569 engaged therewith. The engagement between the upper sleeve 568 and the upper support fin 569 may be threadingly, bonded, glued, etc. In assembly of the plugging device 514, the upper support fin 569 may first be coupled with the upper sleeve 568, and then the upper sleeve (with fin 569) may be engaged with the body 550, such as threadingly.

While the upper sleeve 568 may be made of a rigid material, such as metal, the support fin 569 may be made of a pliable material, such as rubber. The upper sleeve 568 and support fin 569 may help with alignment as the plugging device 514 moves through a valve (202, 202*a*). The body 550 may have a plurality of lateral holes 579. The holes 579 may provide a flow path useful to mitigate or prevent a pressure trap between fins 565, 569. The lateral holes 579 may be proximate to an underside of fin 565.

The body 550 or the upper sleeve 568 may have an upper seat 570. The seat 570 may be configured for a removable plug, such as a ball, 571 to seat thereagainst. The presence of the plug or ball 571 provides the ability for fluid pressure to flow the plugging device 514 downhole toward clusters of valves. The ball 571 may be made of a dissolvable material, which, while not limited, may be metallic. When the ball 571 is seated, flow through the bore 553 may be obstructed; however, when the ball 571 unseats, fluid may flow through the bore 553.

The ball 571 may be held in place via a shoulder catch 572. During pressurization, the ball 571 may be urged against the seat 570 and provide a fluid tight seal. However, fluid may have a tendency to flow around the outside of the plugging device 514. As such, the plugging device may be configured with a seal element 573. When the plugging device 514 engages and opens one of the frac valves (202), force may be exerted by the frac valve seat against a shear ring 574.

The shear ring 574 may be held in place via one or more shear members 575, such as pins, screws, etc. With enough exertion, the shear members 575 may break, and the shear ring 574 may be begin to compress against one or more backup rings 576 and the seal element 573. The seal element 573 may be disposed between a backup ring 576 on each side thereof. The seal element 573 and backup rings 576 may be compressed against and otherwise held in place by an opposite side upper sleeve shoulder 577. Sufficient pressurization may therefore help form a resilient barrier and sealing engagement between the plugging device 514 and the frac valve to which it may be engaged.

Figure 5A:
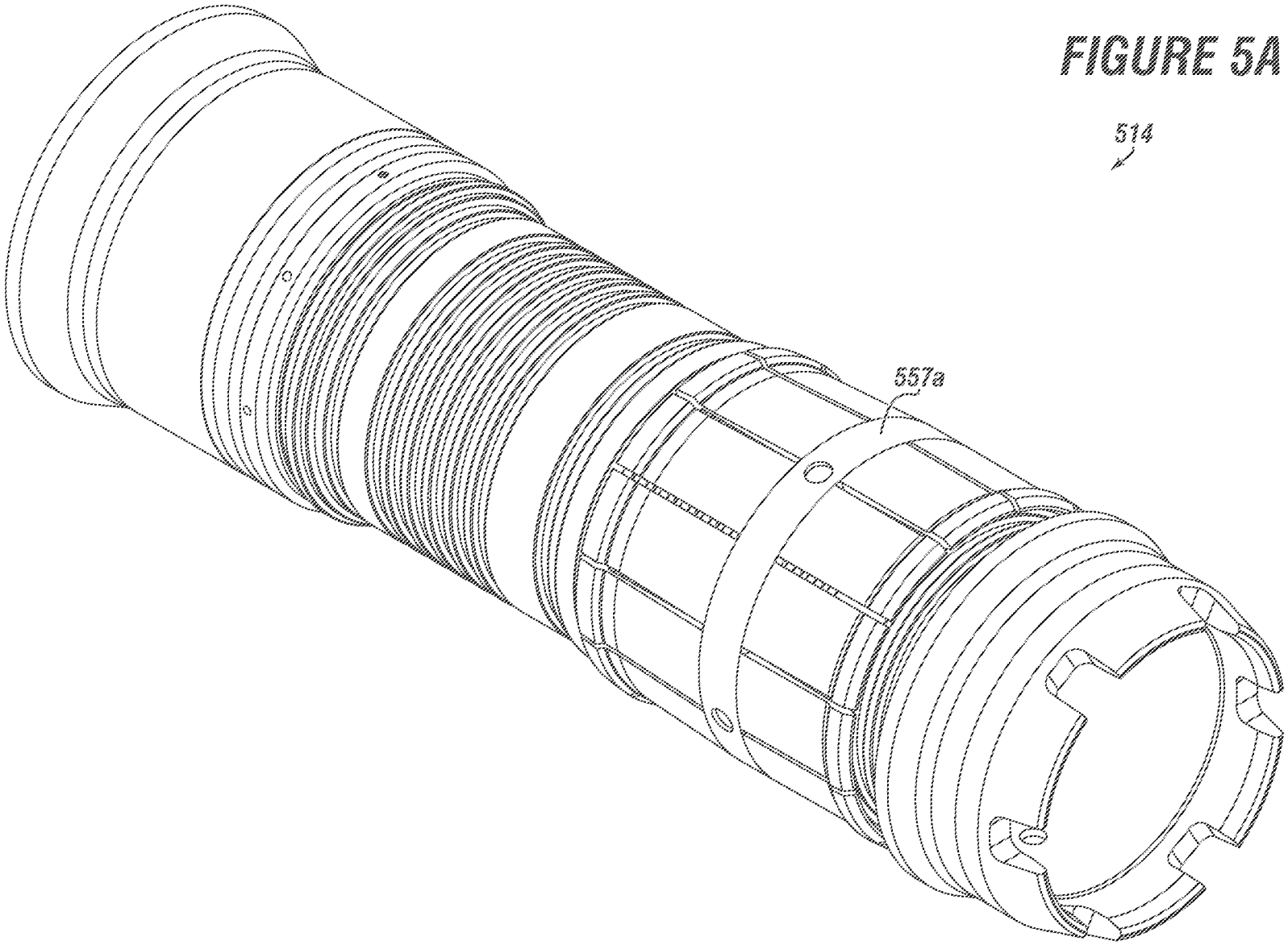
FIG. 5A shows an isometric view of a plugging device, according to embodiments of the disclosure.
Figure 5B:
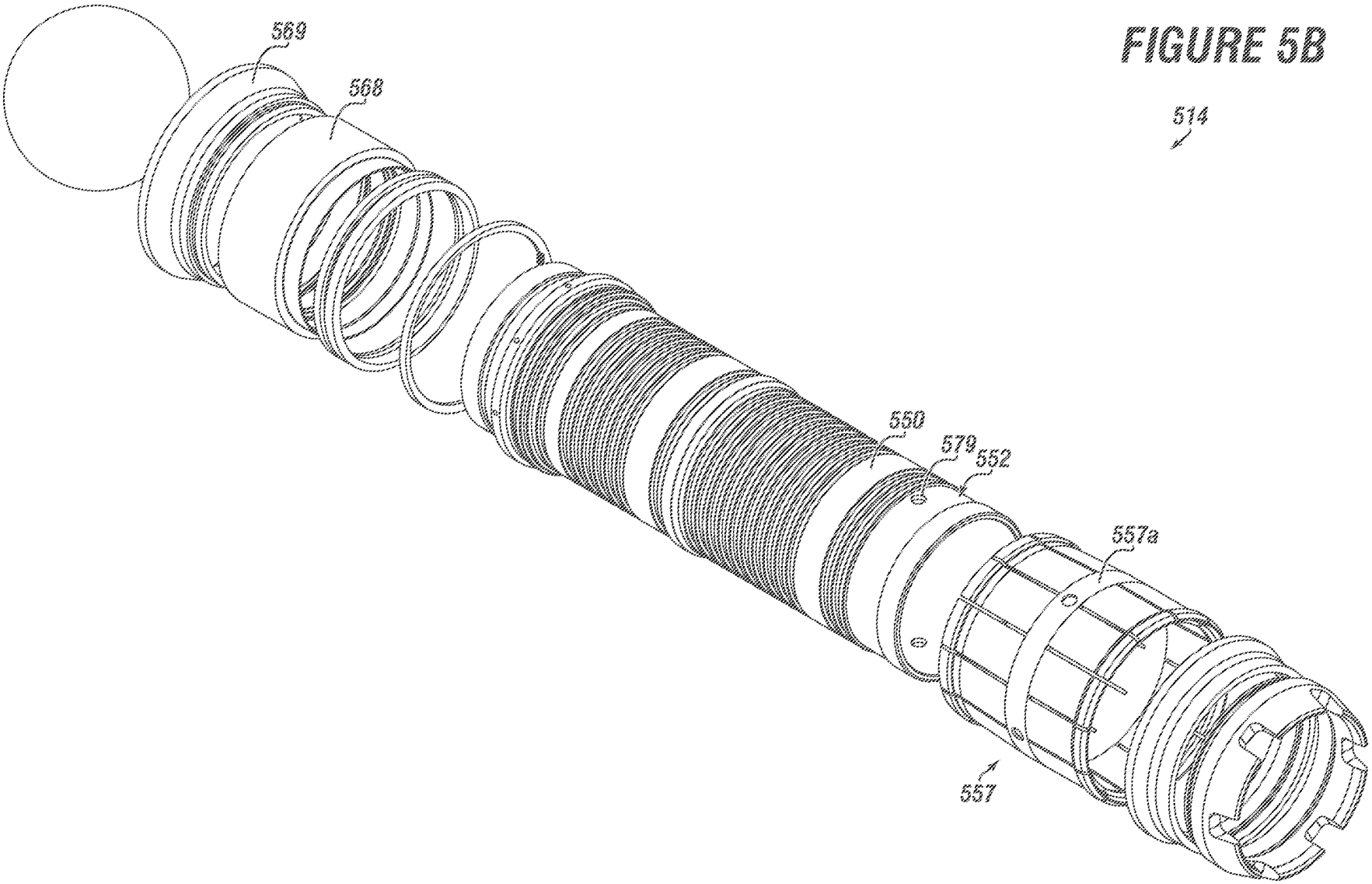
FIG. 5B shows an isometric component breakout view of the plugging device of FIG. 5A, according to embodiments of the disclosure.
Figure 5C:
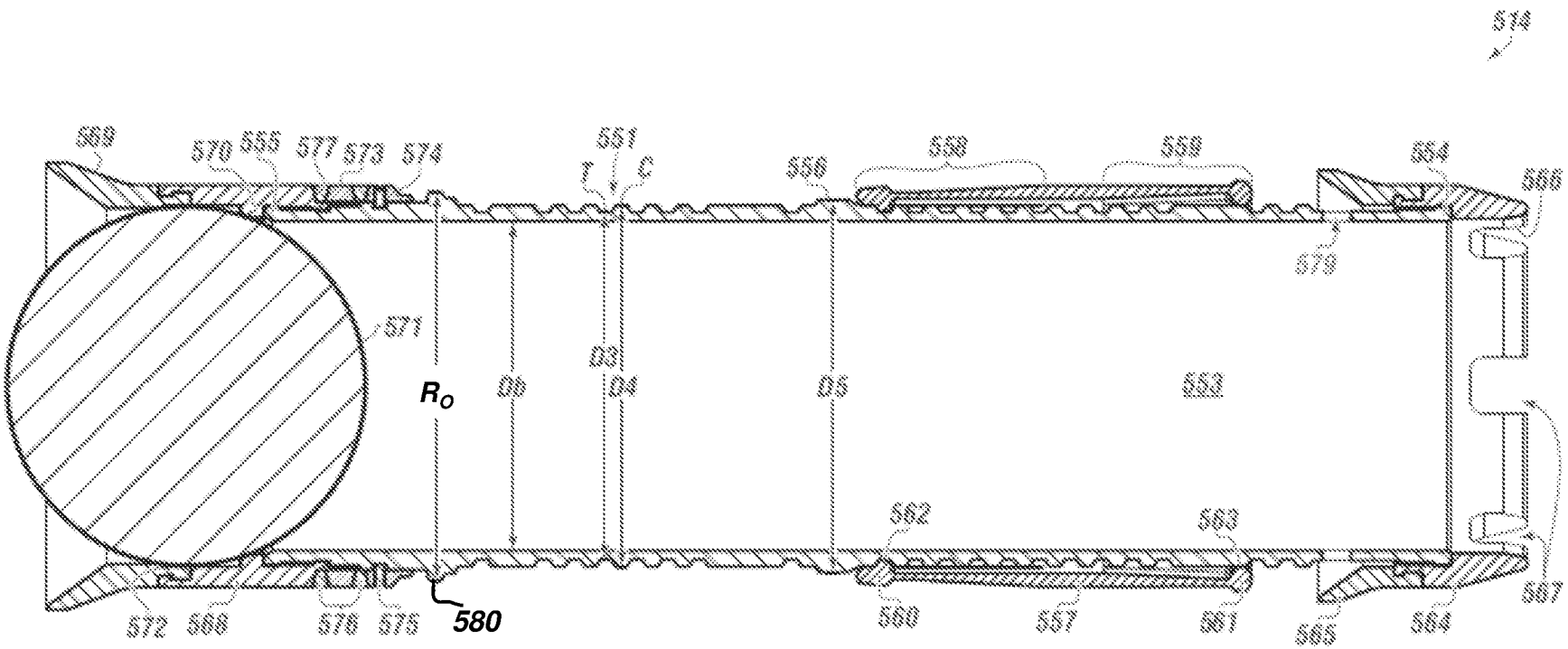
FIG. 5C shows a longitudinal side cross-sectional view of the plugging device of FIG. 5A, according to embodiments of the disclosure.
Figure 5D:
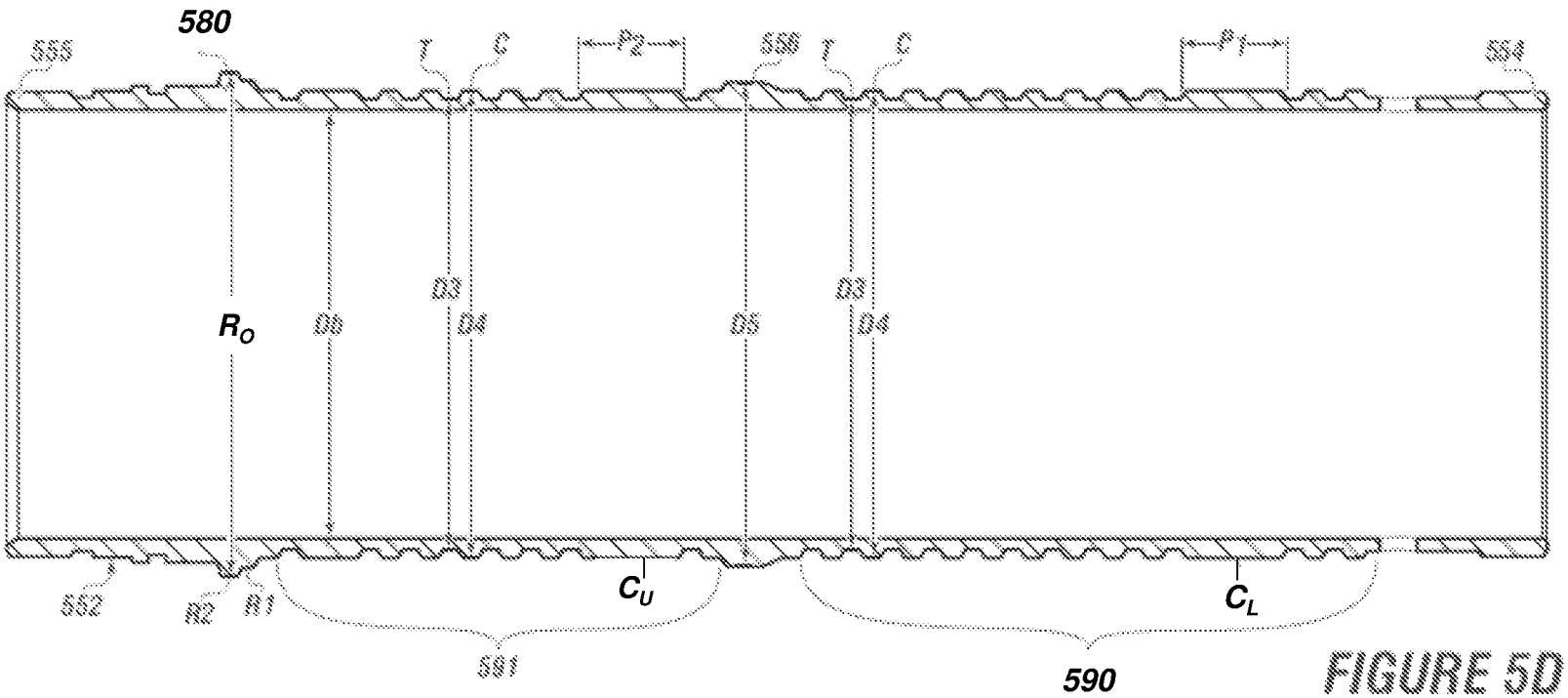
FIG. 5D shows a longitudinal side cross-sectional view a main body of a plugging device configured with a grooved outer surface profile, according to embodiments of the disclosure.

FIG. 5D in particular shows the outer surface 552 may have a profile of grooves 551 thereon. Although not meant to be limited, the grooves 551 may be lateral in the sense that each respective groove begins and ends with itself. The outer surface 552 may have a lower groove profile 590, which may be on or toward the distal end 554. There may be an upper groove profile 591, which may be on or more toward the proximate end 555. The number of grooves 551 in either or both of the profiles 590, 591 is not meant to be limited; however, the number of grooves 551 may be formed (machined, etc.) in a manner to coincide with a number of valves in a cluster of valves.

Generally, each groove 551 may be contemplated as corresponding to a respective crest-trough configuration (e.g., a crest directly adjacent a respective trough). Any trough T of the profiles 590, 591 may have an outer diameter D3, while any respective adjacent crest C may have an outer diameter D4. One of skill would appreciate the outer diameter D4 may be larger than D3.

The lower profile 590 and the upper profile 591 may be separated by an extended rib 556. The extended rib 556 may be comparable to a crest having an outer rib diameter D5. Of note, the outer diameter D5 may be larger than regular crest outer diameter D4.

Although there may be repetitive crest-trough configurations of duplicate dimension, there may be a special geometry attributable to some crests. For example, there may be a lower profile crest $C_L$, and there may be an upper profile crest $C_U$. While the lower profile crest and the upper profile crest may have a comparable diameter to that of D4, the respective crest surfaces may be elongated or extended. As such, the crest $C_L$ may have an extended plateau surface $P_1$. The crest $C_U$ may have an extended plateau surface $P_2$. These plateau surfaces may provide for a distinguished effect of interaction of the index sleeve (557) thereagainst.

The proximate end 555 may have one or more outer ridges R1, R2. The outermost surface 580 of the ridge R2 may have a ridge outer diameter $R_O$. The outer diameter $R_O$ may be the larger OD of any structure on the outer surface 552. As such, the greatest amount of flex of the index sleeve may be needed when the sleeve interacts with the ridge R2.

Figure 6A:
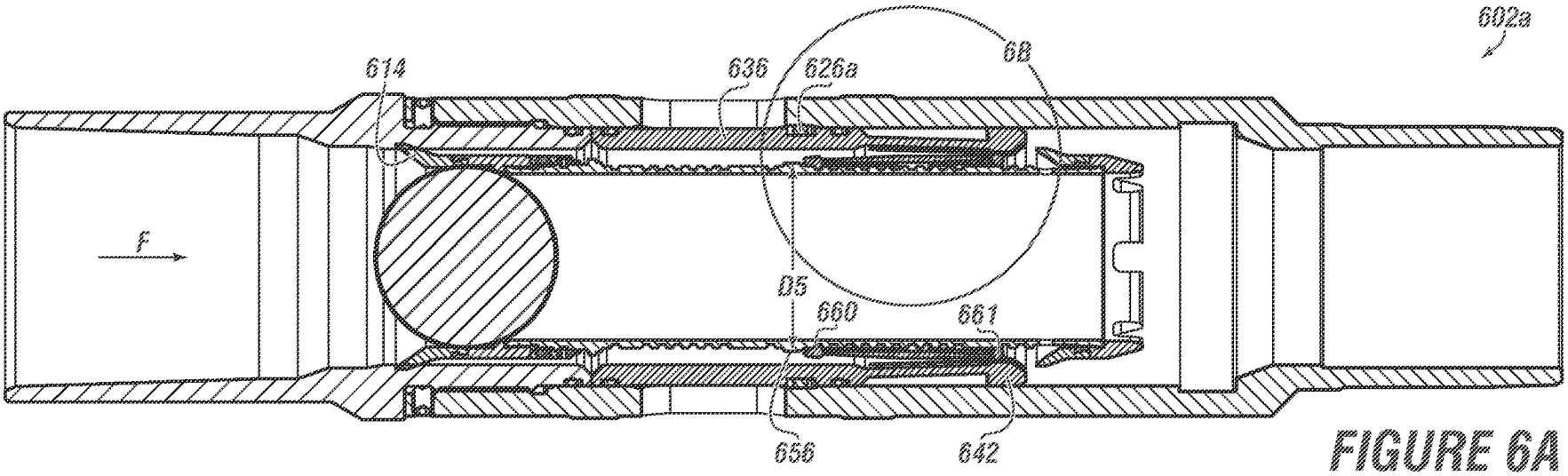
FIG. 6A shows a longitudinal side cross-sectional view of a plugging device seated in a flex valve configured in a closed position, according to embodiments of the disclosure.
Figure 6B:
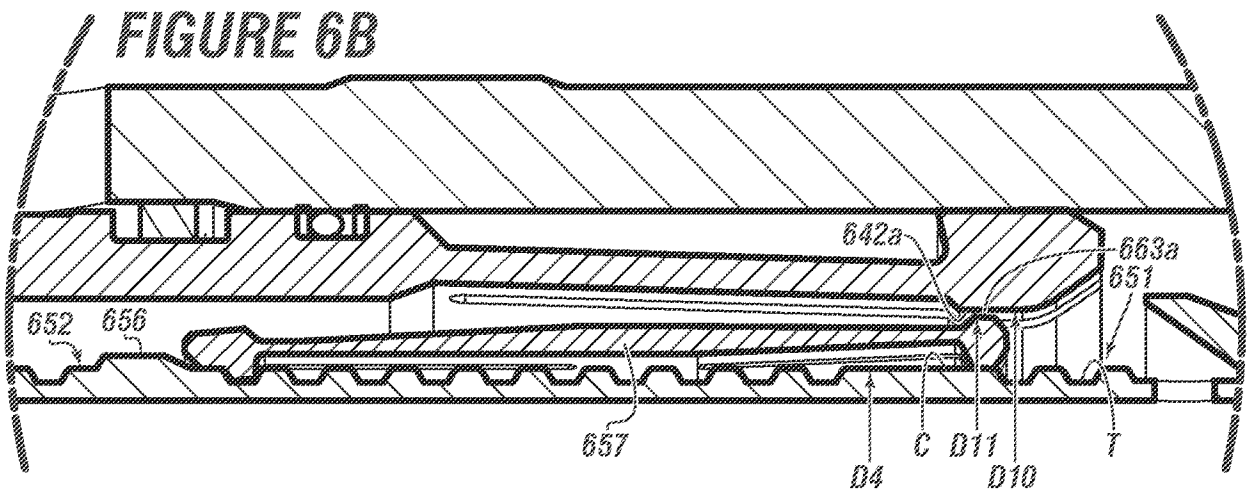
FIG. 6B shows a zoom in view of the plugging device and flex valve of FIG. 6A, according to embodiments of the disclosure.
Figure 6C:
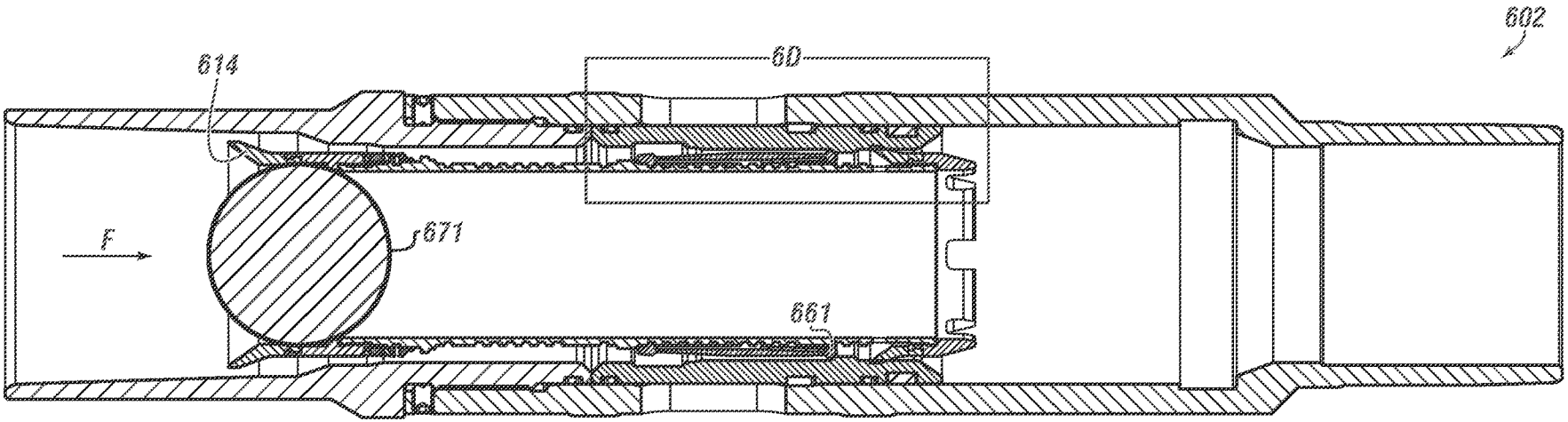
FIG. 6C shows a longitudinal side cross-sectional view of a plugging device seated in a frac valve configured in a closed position, according to embodiments of the disclosure.
Figure 6D:
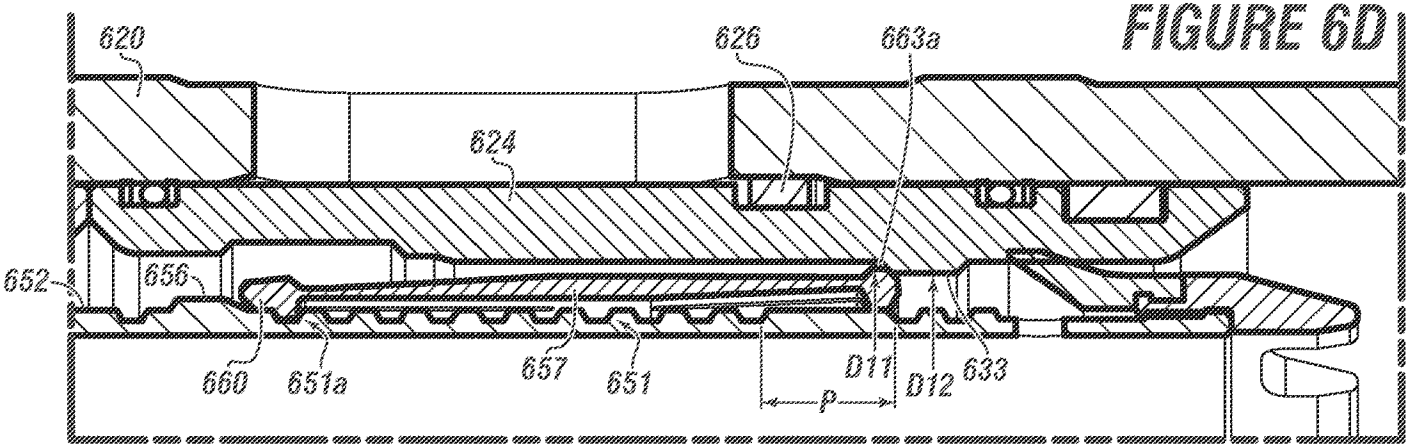
FIG. 6D shows a zoom in view of the plugging device and frac valve of FIG. 6C, according to embodiments of the disclosure.
Figure 6E:
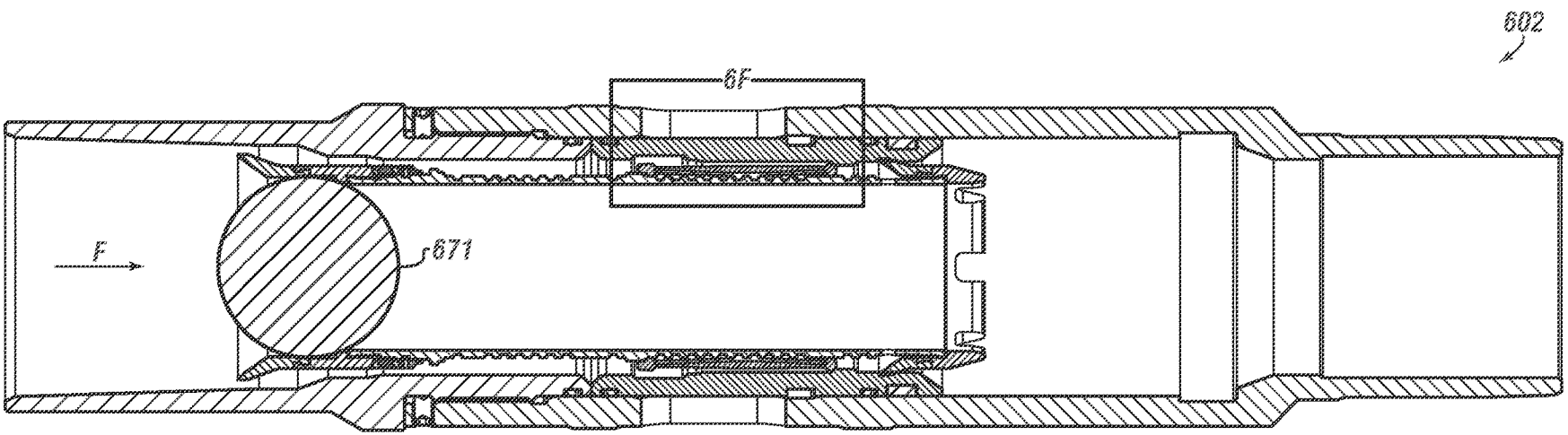
FIG. 6E shows a longitudinal side cross-sectional view of the plugging device and frac valve of FIG. 6C, with an incremented index sleeve, according to embodiments of the disclosure.
Figure 6F:
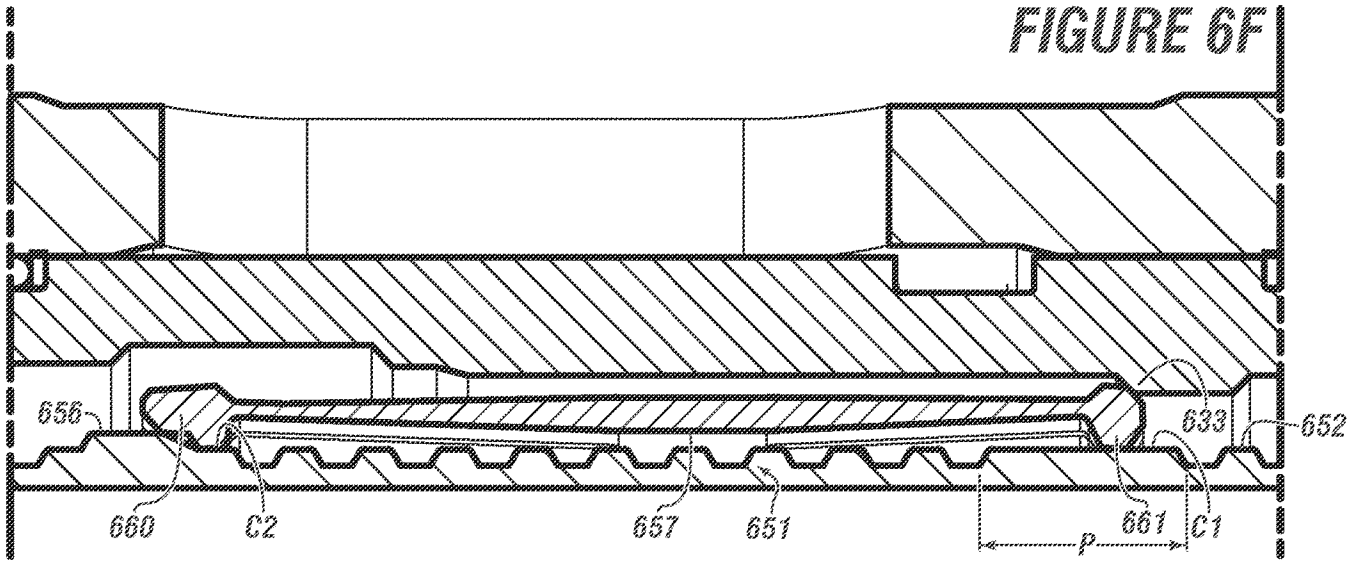
FIG. 6F shows a zoom in view of the plugging device and frac valve of FIG. 6E, with an incremented index sleeve, according to embodiments of the disclosure.
Figure 6G:
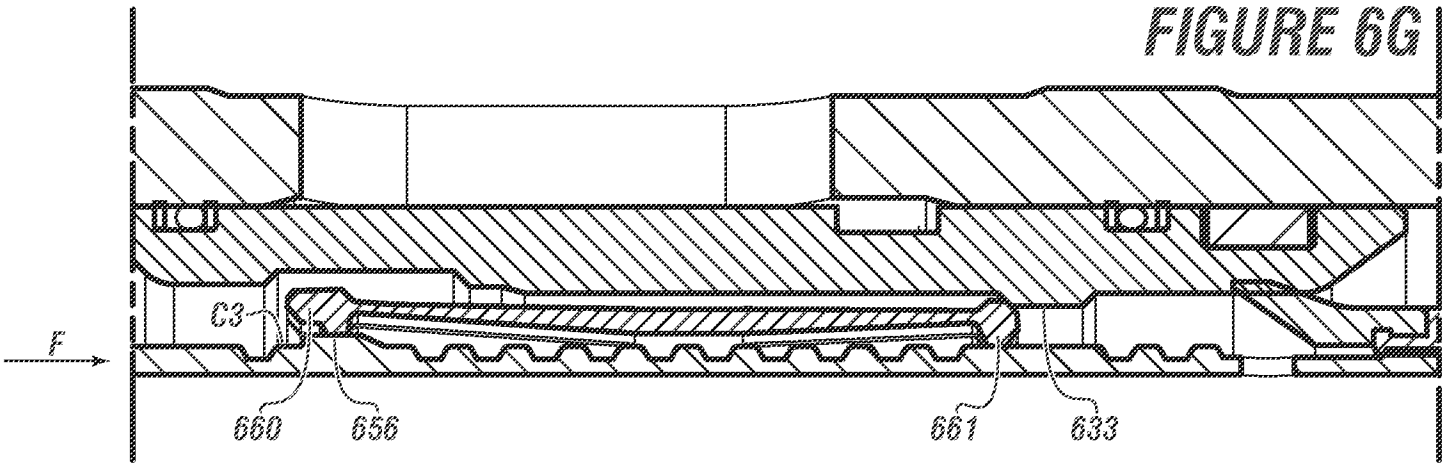
FIG. 6G shows a zoom in longitudinal side cross-sectional view of the plugging device and frac valve of FIG. 6F, with the index sleeve further incremented, according to embodiments of the disclosure.
Figure 6H:
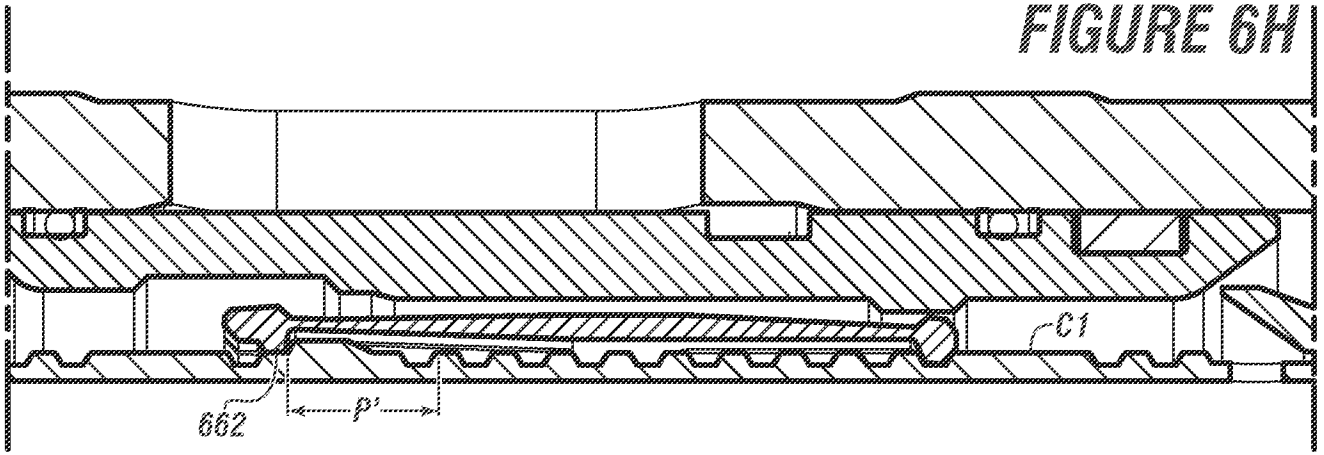
FIG. 6H shows a zoom in longitudinal side cross-sectional view of the plugging device and frac valve of FIG. 6G, with the index sleeve further incremented, according to embodiments of the disclosure.
Figure 6I:
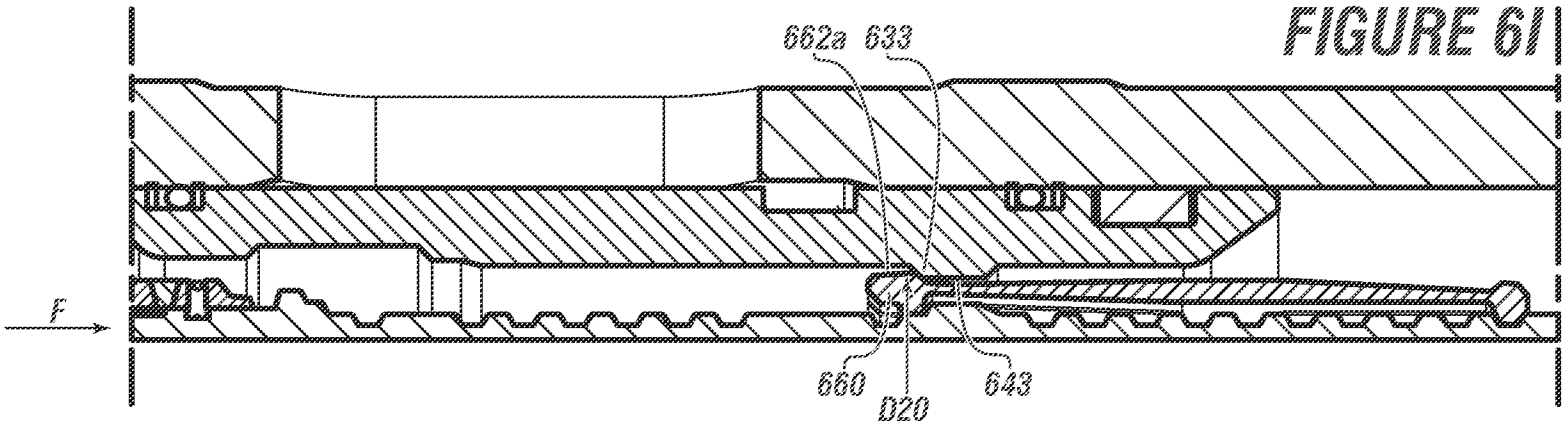
FIG. 6I shows a zoom in longitudinal side cross-sectional view of the plugging device and frac valve of FIG. 6H, with the index sleeve further incremented, according to embodiments of the disclosure.
Figure 6J:
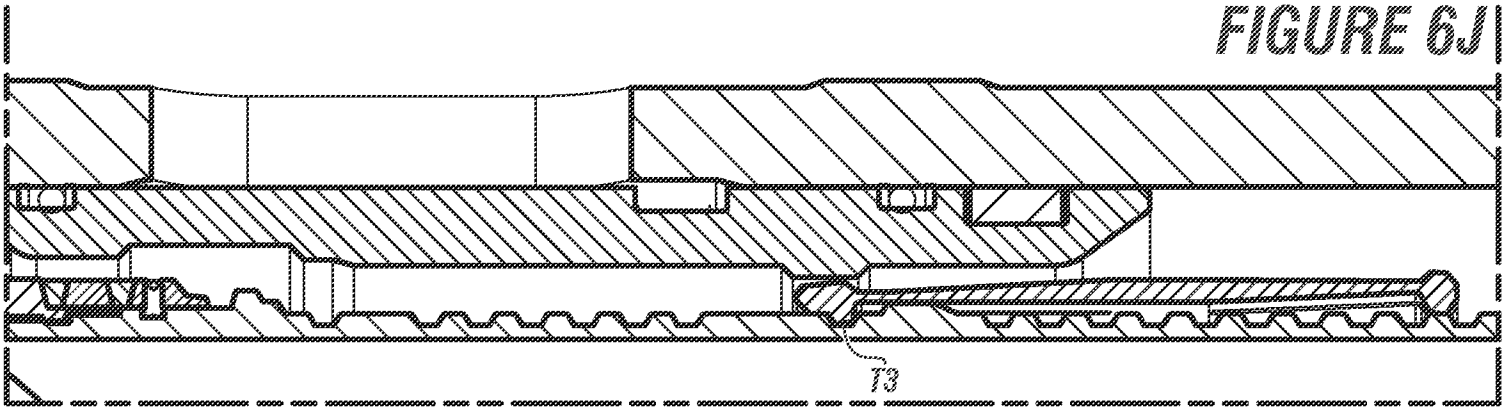
FIG. 6J shows a zoom in longitudinal side cross-sectional view of the plugging device and frac valve of FIG. 6I, with the index sleeve further incremented so that the plugging device may move freely from the frac valve, according to embodiments of the disclosure.
Figure 6K:
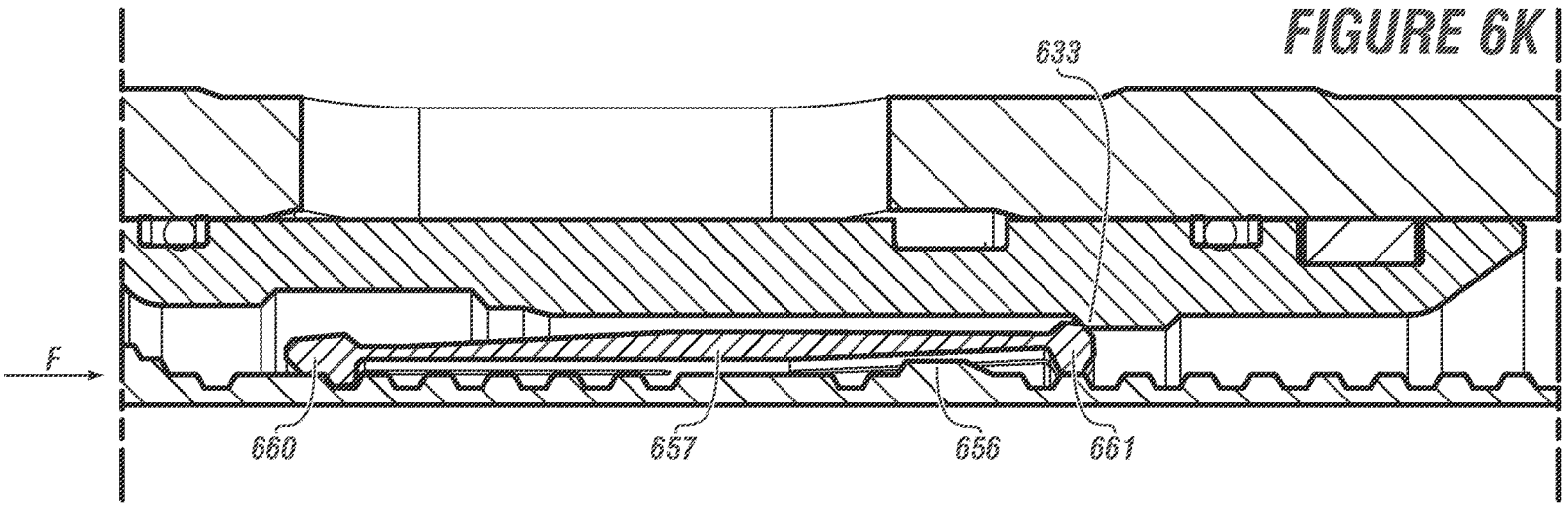
FIG. 6K shows a zoom in longitudinal side cross-sectional view of the plugging device of FIG. 6J, with the index sleeve engaged with another frac valve, according to embodiments of the disclosure.
Figure 6L:
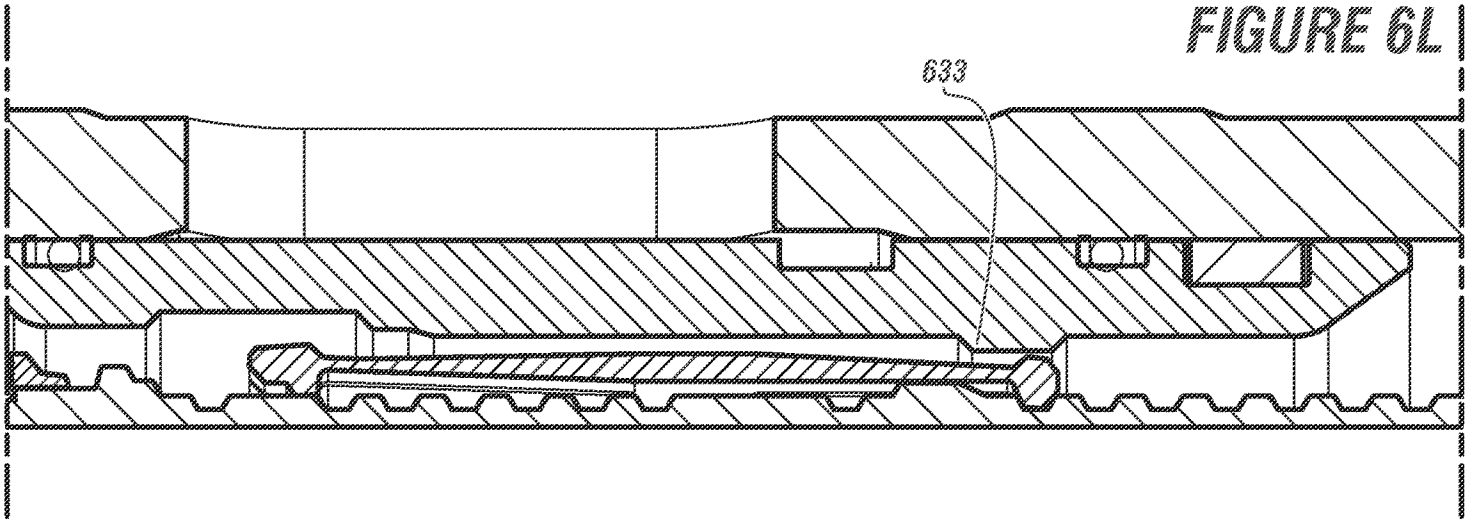
FIG. 6L shows a zoom in longitudinal side cross-sectional view of the plugging device and the another frac valve of FIG. 6K, with the index sleeve further incremented, according to embodiments of the disclosure.
Figure 6M:
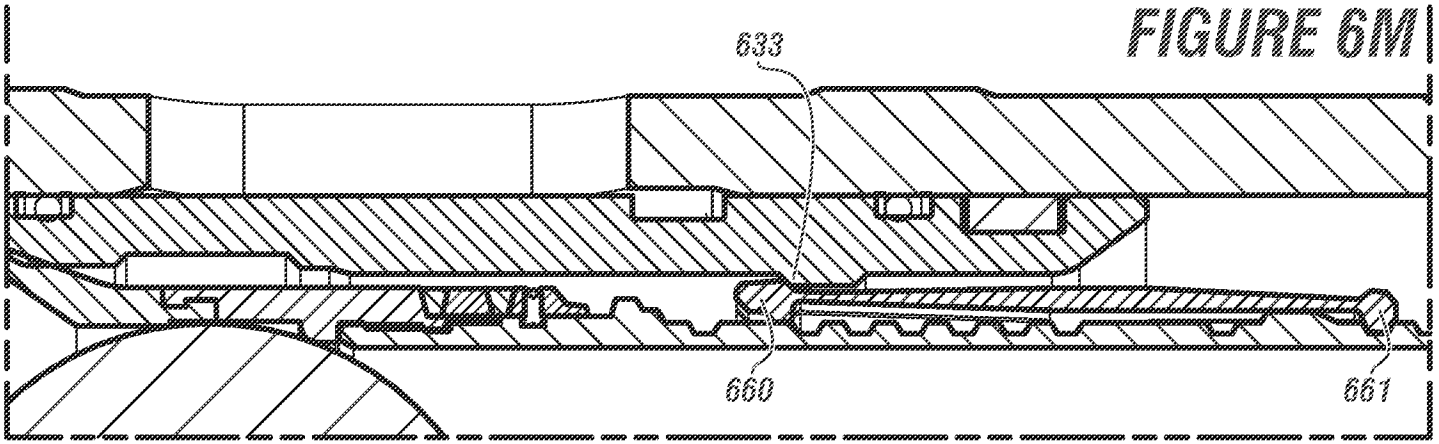
FIG. 6M shows a zoom in longitudinal side cross-sectional view of the plugging device and the another frac valve of FIG. 6L, with the index sleeve further incremented, according to embodiments of the disclosure.
Figure 6M:
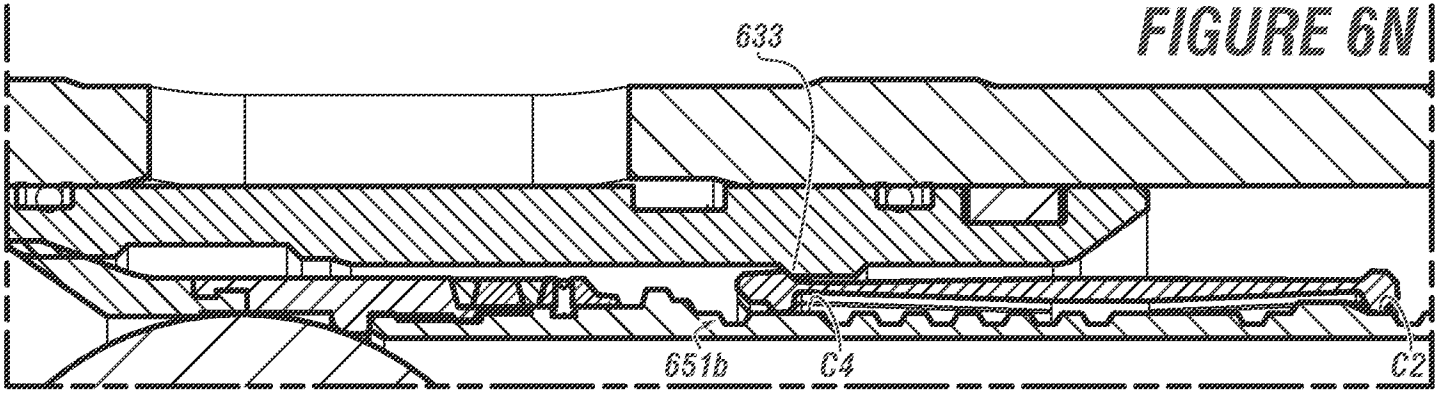
Figure 6O:
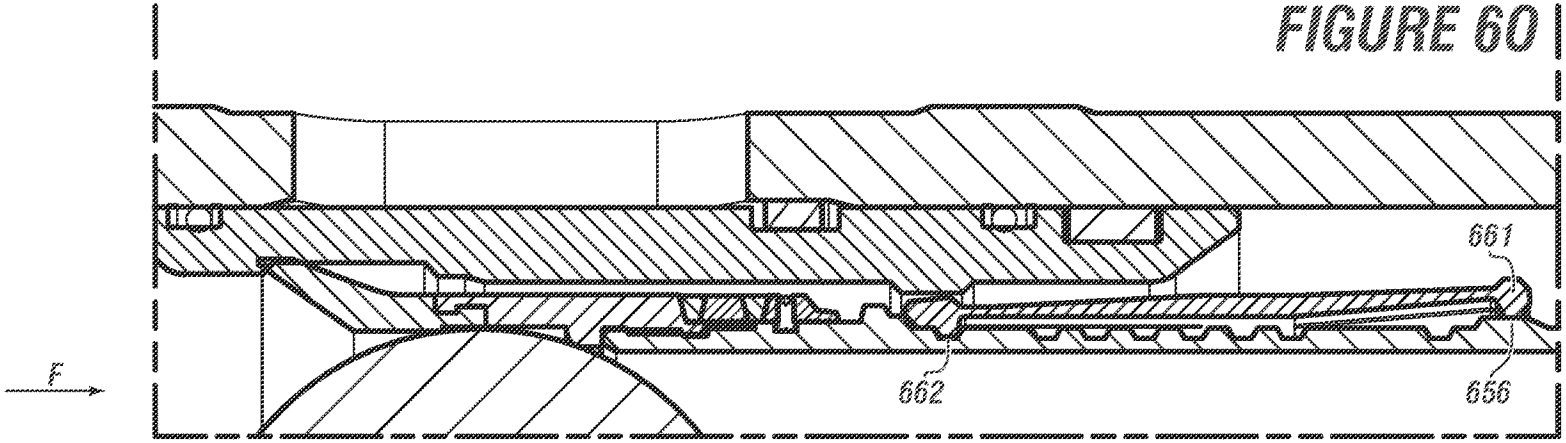
FIG. 6O shows a zoom in longitudinal side cross-sectional view of the plugging device and the another frac valve of FIG. 6N, with the index sleeve further incremented so that the device may move freely from the another frac valve, according to embodiments of the disclosure.
Figure 6P:
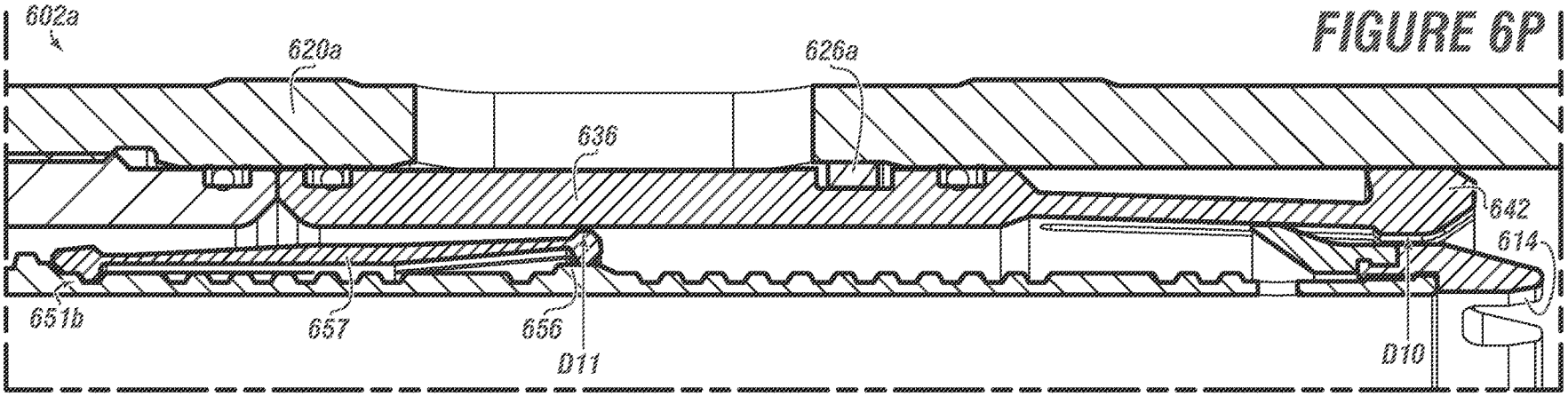
FIG. 6P shows a zoom in longitudinal side cross-sectional view of the plugging device of FIG. 6O, with the index sleeve in a position to engage a flex valve, according to embodiments of the disclosure.
Figure 6Q:
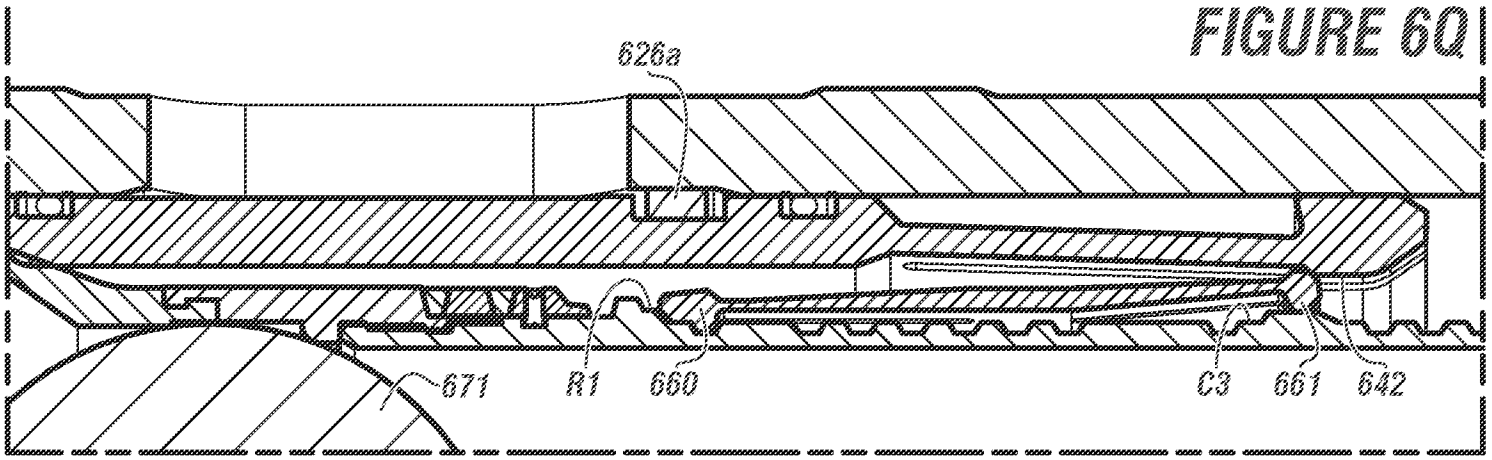
FIG. 6Q shows a zoom in longitudinal side cross-sectional view of the plugging device and the flex valve of FIG. 6P, with the index sleeve engaged with the flex valve, according to embodiments of the disclosure.
Figure 6R:
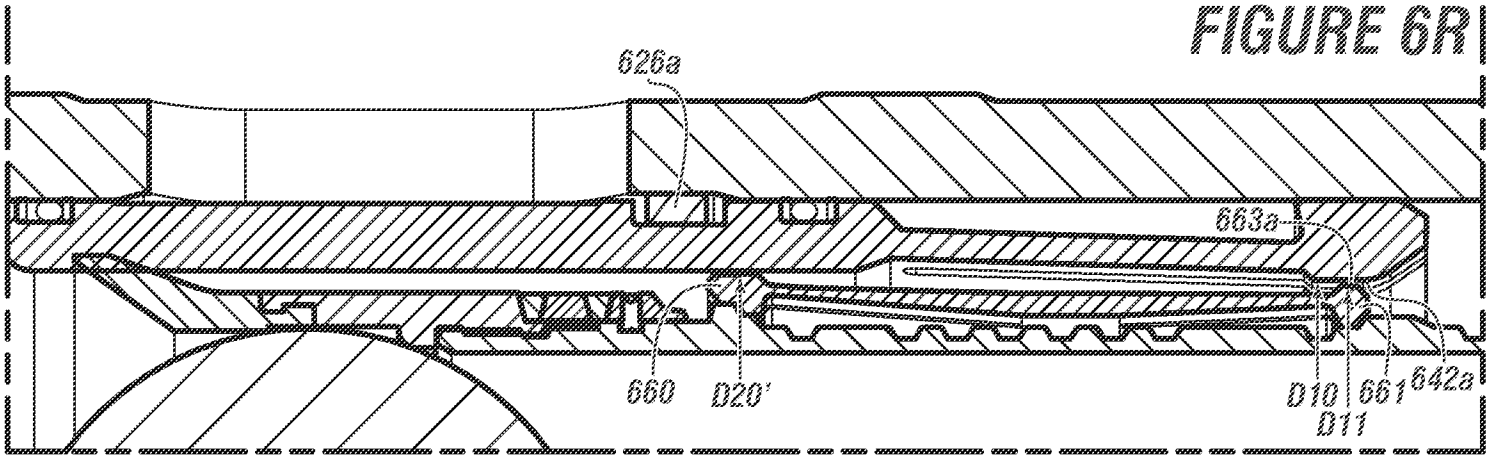
FIG. 6R shows a zoom in longitudinal side cross-sectional view of the plugging device and the flex valve of FIG. 6Q, with the index sleeve incremented further, according to embodiments of the disclosure.
Figure 6S:
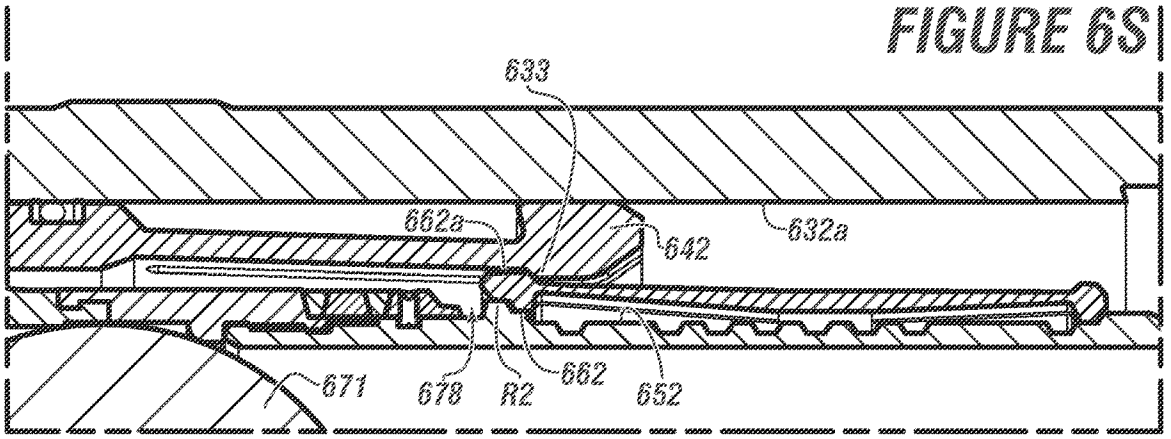
FIG. 6S shows a zoom in longitudinal side cross-sectional view of the plugging device and the flex valve of FIG. 6R, with the index sleeve re-engaged with the flex valve, according to embodiments of the disclosure.
Figure 6T:
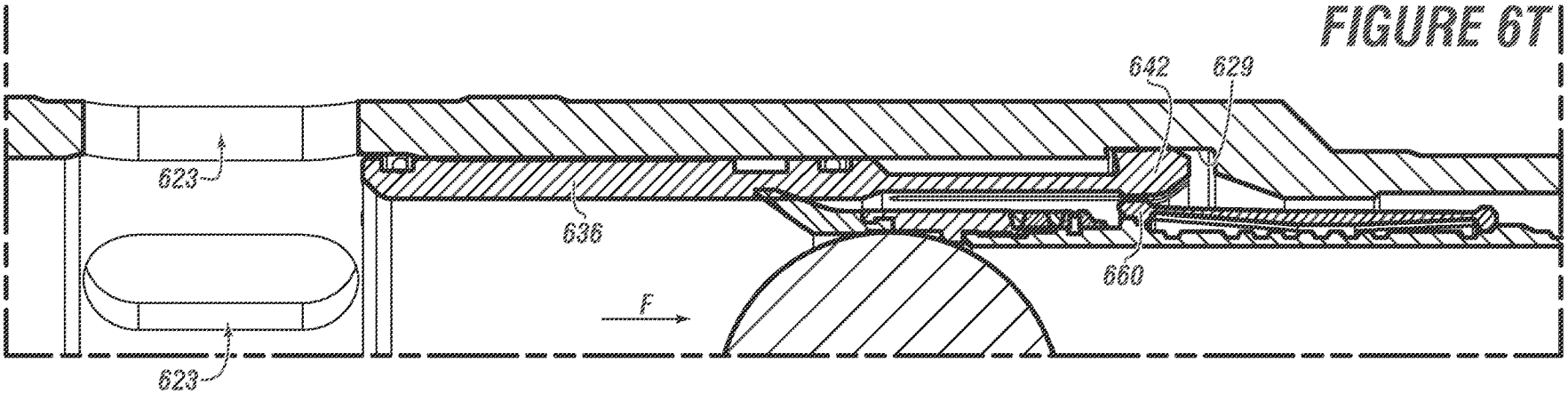
FIG. 6T shows a zoom in longitudinal side cross-sectional view of the plugging device having moved the flex valve of FIG. 6S to an open position, according to embodiments of the disclosure.
Figure 6U:
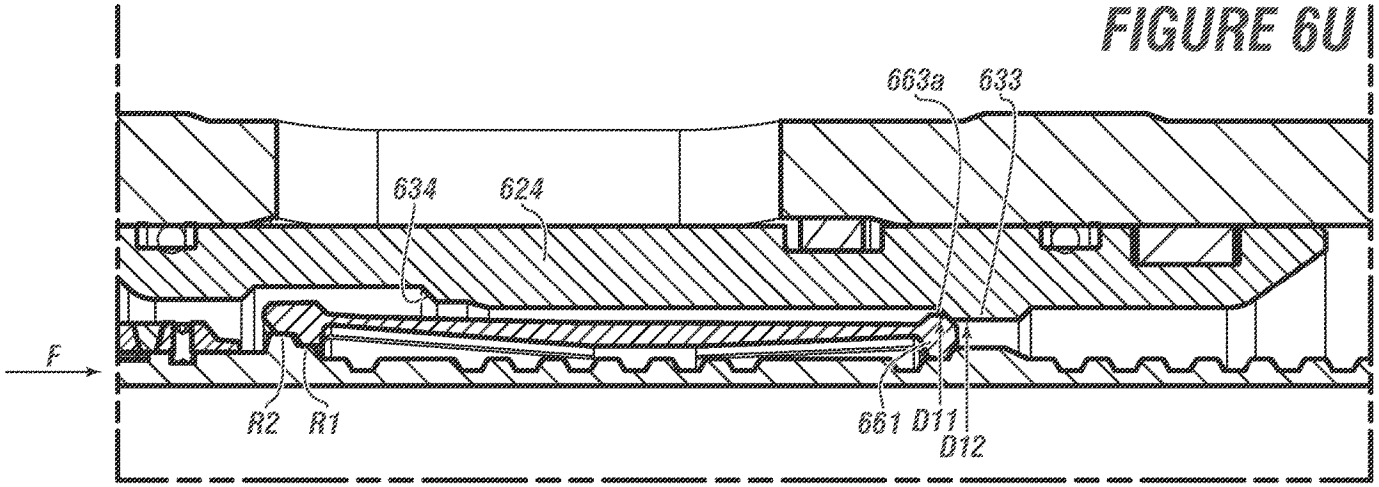
FIG. 6U shows a zoom in longitudinal side cross-sectional view of the plugging device engaged with another frac valve after moving a flex valve to an open position, according to embodiments of the disclosure.
Figure 6V:
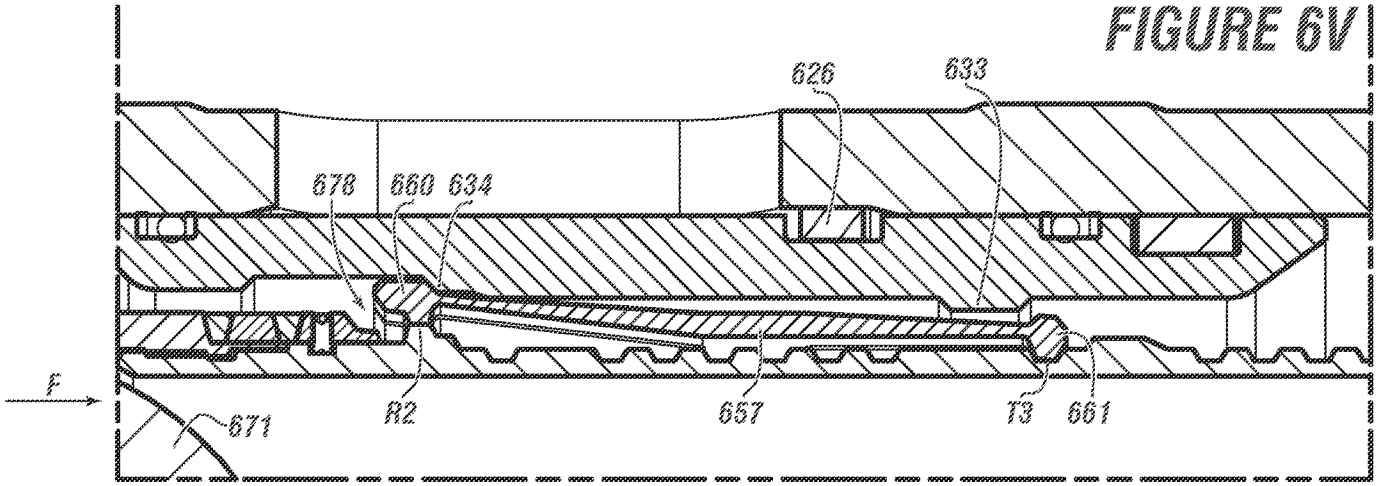
FIG. 6V shows a zoom in longitudinal side cross-sectional view of the plugging device and the frac valve of FIG. 6U, with the index sleeve incremented further, according to embodiments of the disclosure.
Figure 6W:
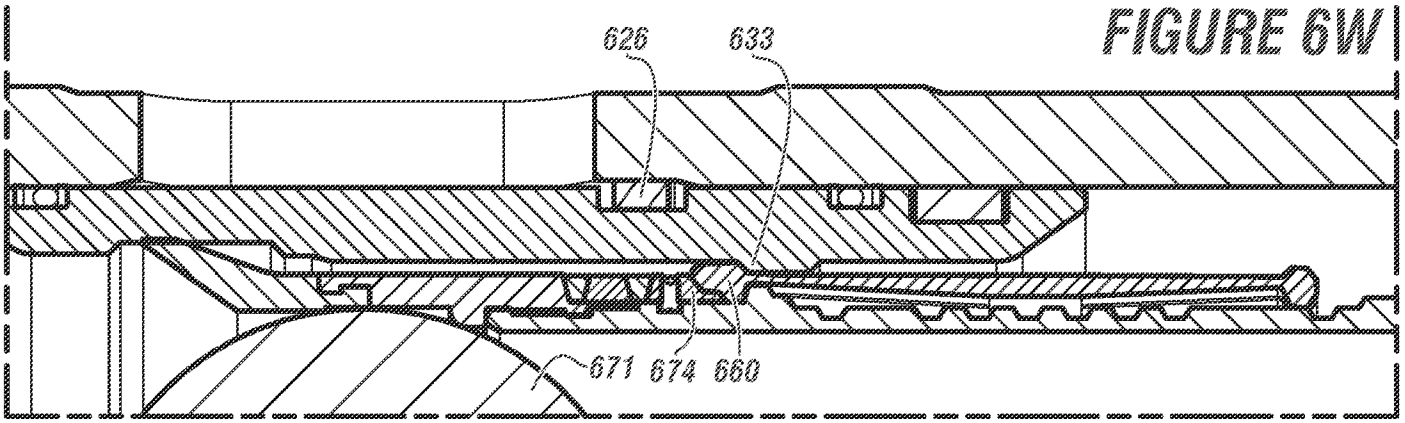
FIG. 6W shows a zoom in longitudinal side cross-sectional view of the plugging device and the frac valve of FIG. 6V, with the index sleeve incremented further to its final position, according to embodiments of the disclosure.
Figure 6X:
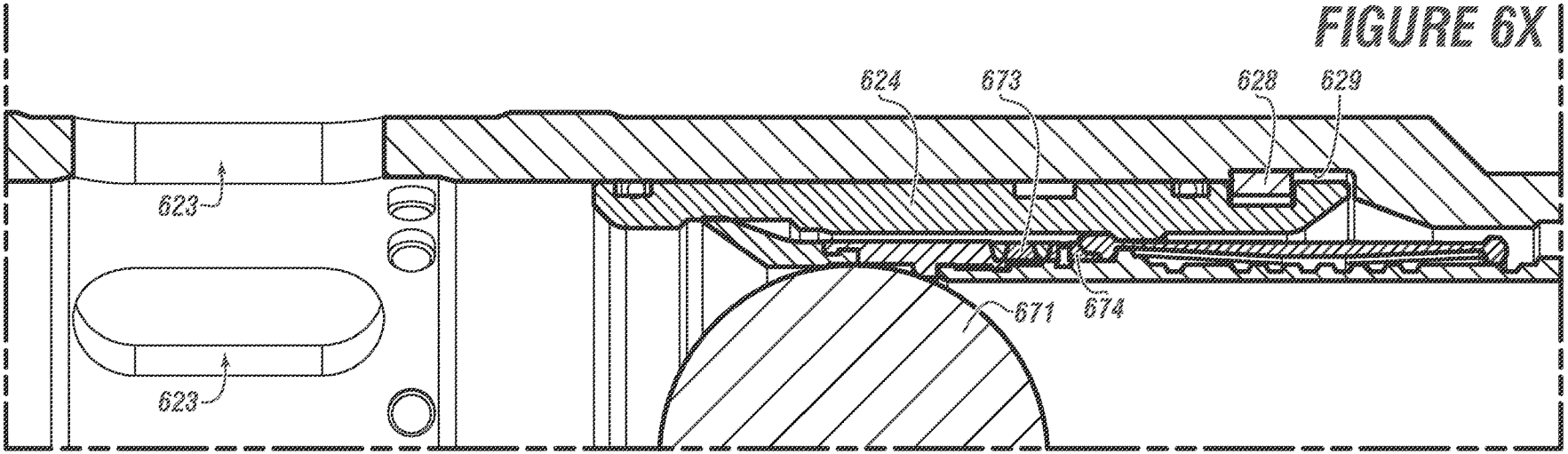
FIG. 6X shows a zoom in longitudinal side cross-sectional view of the plugging device having moved the frac valve of FIG. 6W to an open position, according to embodiments of the disclosure.

Referring now to FIGS. 6A-6X, a longitudinal side cross-sectional view of a plugging device seated in a flex valve configured in a closed position; a zoom in view of the plugging device and flex valve; a longitudinal side cross-sectional view of a plugging device seated in a frac valve configured in a closed position; a zoom in view of the plugging device and frac valve; a longitudinal side cross-sectional view of the plugging device and frac valve, with an incremented index sleeve; a zoom in view of the plugging device and frac valve, with an incremented index sleeve; a zoom in longitudinal side cross-sectional view of the plugging device and frac valve, with the index sleeve further incremented; a zoom in longitudinal side cross-sectional view of the plugging device and frac valve, with the index sleeve further incremented; a zoom in longitudinal side cross-sectional view of the plugging device and frac valve, with the index sleeve further incremented; a zoom in longitudinal side cross-sectional view of the plugging device and frac valve, with the index sleeve further incremented so that the plugging device may move freely from the frac valve; a zoom in longitudinal side cross-sectional view of the plugging device, with the index sleeve engaged with another frac valve; a zoom in longitudinal side cross-sectional view of the plugging device and the another frac valve, with the index sleeve further incremented; a zoom in longitudinal side cross-sectional view of the plugging device and the another frac valve, with the index sleeve further incremented; a zoom in longitudinal side cross-sectional view of the plugging device and the another frac valve, with the index sleeve further incremented; a zoom in longitudinal side cross-sectional view of the plugging device and the another frac valve, with the index sleeve further incremented so that the device may move freely from the another frac valve; a zoom in longitudinal side cross-sectional view of the plugging device, with the index sleeve in a position to engage a flex valve; a zoom in longitudinal side cross-sectional view of the plugging device and the flex valve, with the index sleeve engaged with the flex valve; a zoom in longitudinal side cross-sectional view of the plugging device and the flex valve, with the index sleeve incremented further; a zoom in longitudinal side cross-sectional view of the plugging device and the flex valve, with the index sleeve re-engaged with the flex valve; a zoom in longitudinal side cross-sectional view of the plugging device having moved the flex valve to an open position; a zoom in longitudinal side cross-sectional view of the plugging device engaged with another frac valve after moving a flex valve to an open position; a zoom in longitudinal side cross-sectional view of the plugging device and the frac valve, with the index sleeve incremented further; a zoom in longitudinal side cross-sectional view of the plugging device and the frac valve, with the index sleeve incremented further to its final position; and a zoom in longitudinal side cross-sectional view of the plugging device having moved the frac valve to an open position.

FIGS. 6A-6X show together the interaction between a plugging device and a respective valve. The device and respective valve may be engaged together to form a valve-device assembly suitable for use in a wellbore. The valve may be of one or more clusters of valves for use in a multistage frac operation. Any cluster may be a plurality of flex valves and a single frac valve.

The Figures illustrate the respective valve and plugging device as an assembly. While the Figures may not show a surrounding formation, wellbore, surrounding tubular/tubestring, and so forth, general understanding may be obtained by reference back to FIGS. 2A and 2B. As such, for the sake of brevity, side views of the interaction of the valve and plugging device are shown, some with zoom-in. When the valve and plugging device are used in a downhole system, applied fluid pressure down the tubular (204) may cause a toe valve (216) to shift open, exposing ports in the toe valve through which fluid F may be pumped into the formation (210). This may allow for fluid flow through the tubular and one or more plugging devices 614 may be pumped downhole. Any displaced fluid from pumping may exit through the ports in the toe valve, and out to the formation.

As shown first in FIG. 6A (with zoom-in view in FIG. 6B), the plugging device 614 may be moved into engagement with a flex valve 602*a* (the flex valve 602*a* being readily discernable from the presence of a flex sleeve 636). Prior to passing into and through the flex valve 602*a*, the plugging device 614 may have passed through other flex valves (not shown here), as well as one or more frac valves (with a solid sleeve instead of a flex sleeve—not shown here). The effect of passing through the frac valve may be that an index sleeve 657 may be moved along an outer surface 652 of the plugging device via interaction therewith. Each frac valve passed through may increment the index sleeve 657 one groove 651.

However, the plugging device 614 may be precluded or otherwise configured from interacting with or otherwise opening a given flex valve 602*a*. As shown in FIGS. 6A and 6B together, when the flex sleeve 636 is closed (and may be held closed via one or more retainers 626*a*) a lower end 661 of the index sleeve 657 may have enough clearance to move past ends 642 of collet fingers 640 (of collet 639) without causing the flex sleeve 636 to open. Regardless of whether the lower end 661 is in a trough T or on a crest C (with outer crest diameter D4) of a respective groove 651, an outer lower end diameter D11 of lower end outer surface 663*a* is still less than an inner diameter D10 of a lower collet end inner surface 642*a*. The upper collet end 660 may also have sufficient clearance. The plugging device 614 may pass freely through any flex valve 602*a* until the lower end 661 is bumped out onto an extended rib 656 (having outer diameter D5 being larger than D4), at which point there is no more clearance (see, e.g., FIG. 6P).

FIGS. 6C and 6D together illustrate the plugging device 614 may be moved into engagement with a frac valve 602. Engagement of the two components may result in a valve-device assembly. The frac valve 602 may have a main body 620 engaged with a solid frac sleeve 624. The sleeve 624 may be sealingly and movingly engaged with the body 620, albeit initially retained in a first (or closed) position shown, as shown here, via one or more retainer members 626.

Readily apparent is that as the lower end 661 resides on the crest C of any respective groove 651 (of surface 652), the outer lower end diameter D11 of the lower end surface 663*a* may be larger than an inner shoulder diameter D12 of an inner sleeve shoulder 633, resulting in engagement of the lower collet end 661 with the shoulder 633. Force (such as via pressurization) against the plugging device 614 (via its plug or ball 671) may urge these surfaces together until the lower end 661 may be bumped or incremented into a next respective trough T. This sequence may be repeatable as the plugging device 614 engages other frac valves 602 within the wellbore (206).

Distinguished by FIGS. 6C and 6D is that the index sleeve 657 may have cycled enough (such as through enough frac valves 602) whereby the upper end 660 of the index sleeve 657 may have an inner end surface residing in a trough T of a groove 651*a* directly downhole adjacent the extended rib 656.

FIGS. 6E and 6F show the further sequence of movement of the index sleeve 657 with respect to surface 652 when in the adjacent downhole vicinity of rib 656. As shown, instead of being bumped into a next trough, the lower collet end 661 remains on an elongated crest C1 configured with an extended plateau P. The lower collet end 661 therefore remains engaged with shoulder 633, which facilitates bumping the upper end 660 out of the groove 651*a* onto an adjacent crest C2.

Downward force, such as from pressure of fluid F against the ball 671, may continue to urge device 614 downward as shown in FIGS. 6G and H, whereby the lower collet end 661 continues to slide along crest C1 while the upper collet end 660 may be bumped onto an outer rib surface of the extended rib 656. FIG. 6H in particular shows the point just where the lower collet end 661 leaves crest C1 into a next uphole trough (thereby providing sufficient clearance between end 661 and shoulder 633). Simultaneously the upper collet end 660 may be moved off rib 656, and upper collet inner surface 662 engages onto next adjacent crest C3.

With sufficient clearance between end 661 and shoulder 633, the plugging device 614 may now continue further downward until the view illustrated by FIG. 6I, whereby an outer shoulder surface 662*a* of upper collet end 660 may come into contact with the sleeve shoulder 633. As an outer diameter of the shoulder surface 662*a* (at the point where end 660 resides on crest C3) may be larger than the inner diameter of shoulder inner surface 643, the device 614 may be held up within the valve 602.

FIG. 6J illustrates the collet end 660 bumped into the next uphole trough T3, and thus enough clearance exists between the end 660 and the shoulder 633 whereby the device 614 may now leave or otherwise move freely of the valve 602 without the sleeve (624) being opened. It is noted that in this configuration the ends 660, 661 of the index sleeve 657 may still be at a position with sufficient clearance to pass through any subsequent flex valve 602*a*.

The count sequence of incrementing the index sleeve 657 as the device 614 engages subsequent downhole frac valves 602 may continue as desired, subject to changing the length of the device 614 and the plurality of grooves thereon 651 (corresponding to the number of clusters or stages that may be part of the downhole system, e.g., 200).

The repeatable sequence may continue until the device 614 engages a frac valve 602 of a cluster proceeding the last (or target) frac valve to which it is desired for the device 614 to open. This particular sequence of steps may be viewed in FIGS. 6K, 6L, 6M, 6N, and 6O together.

First, FIG. 6K shows index sleeve has been incremented until the lower end 661 may be on a final crest before the last trough adjacent the extended rib 656. FIG. 6L next shows the lower end 661 of the sleeve 657 may be urged (bumped) by shoulder 633 into the last trough downhole-adjacent the extended rib 656. At the same time, the upper end 660 may be bumped onto an elongated crest C4.

The lower end 661 of the index sleeve 657 may now have enough clearance to move past shoulder 633. As such, the device 614 may continue downhole until the upper end 660 may move into engagement with the shoulder 633, as shown in FIG. 6M.

Continued force exerted against the shoulder 633 results in movement of the upper end 660 along the crest C4, while at the same time lower end 661 moves from the respective trough to the crest C2 downhole adjacent the extended rib 656, as shown in FIG. 6N.

Finally, the inner end surface 662 of upper end 660 may be moved into a last trough of groove 651*b*, while at the same time the lower end 661 may now be moved onto the outer surface of the rib 656, as shown in FIG. 6O. This Figure illustrates a first or preliminary 'armed' position of the device 614 as it leaves the respective frac valve (notably without opening the valve) and continues further downhole. The first armed position may coincide with the first time the plugging device 614 may be able to engage a flex valve 602*a*.

FIG. 6P illustrates the plugging device 614 now reaching a first flex valve 602*a* of a last cluster of valves. As with other flex valves, there may be a flex sleeve 636 engaged with a main body 620*a* in a first or closed position. The flex sleeve 636 may be held in the first position via one or more retainer members 626*a*.

Comparing FIG. 6B with FIG. 6O, one of skill would appreciate the increase in outer diameter D11 as a result of the added dimension (wall thickness) of extended rib 656 as compared to that of any respective crest C. With extended D11 now larger than D11 when end 661 rests on a typical crest (e.g., 6B), the lower end 661 may now engage the shoulder 633. FIGS. 6Q and 6R together illustrate the plugging device 614 moving from a first armed position to a primary armed position. FIG. 6Q first illustrates the lower end 661 may be moved into engagement with shoulder 633 as a result of the extended diameter D11. Force (such as from fluid pressure of fluid F) may be applied against the ball 671, and the movement of the lower end 661 with respect to the extended rib 656 may occur.

Continued movement results in bumping the upper end 660 out of the groove 651*a* to the next crest, and then, instead of a subsequent trough, to a next ridge R1, which may coincide with the primary armed position of the sleeve 657. At the same time, FIG. 6R shows the lower end 661 may be moved off the extended rib 656 and onto crest C3 (with D11 now reduced to that of 6B). Analogous to that of FIGS. 6A and 6B, the outer surface 663*a* of the lower end 661 may now have its outer diameter D11 less than the inner diameter D1 of the inner sleeve surface D10, thereby providing adequate clearance for the device 614 to continue further downhole.

In contrast to FIGS. 6A and 6B where the upper end 660 may have had sufficient clearance to avoid shoulder 633, as shown in FIGS. 6Q and 6R together, with the upper end 660 bumped onto the ridge R1 (as well as having its profile engaged with ridge R2), the outer surface 662*a* now has its outer diameter D20' larger than inner diameter D10 of shoulder inner surface 643. In this respect, the plugging device 614 may now be in its second or primary 'armed' position.

As shown particularly in FIG. 6S, there may no longer be any lateral clearance between sleeve wall 632*a*, fingers 642, upper end 660, and outer surface 652, and as such, the end 660 does not have a freedom of movement. Force may increase against the ball 671 until the weakest point breaks. The weakest point may be predetermined, such as retainer members 626*a*.

Once the members 626*a* break, further force against the plugging device 614 may urge the sleeve 636 further downhole until the fingers 642 (as a result of bias) extend outward into retainer slot 629. Once this occurs, the valve 602*a* may be in the second position, and ports 623 may be (fully) open, as shown in FIG. 6S. As the end 660 may now clear the fingers 642, the plugging device 614 may move further downhole. As one of skill would appreciate, the configuration of the end 660 engaged with ridges R1 and R2 (i.e., the primary armed position) means the sequence for Figure S-T of opening a valve may be repeated for any subsequent flex valve 602*a* that may be part of the last (target) cluster.

Ultimately, the plugging device 614 may engage the last frac valve (with solid sleeve) 602 of the target cluster, as shown in FIG. 6U. As shown, the plugging device 614 remains in the primary armed position via engagement of end 660 with ridges R and R2. Akin to FIGS. 6C and 6D, this may leave the lower end 661 with its outer surface 663*a* having outer diameter D11. In a similar manner, the sleeve 624 may have an inner surface of sleeve shoulder 633 with inner diameter D12 that may be less than D11. Force against the ball 671 from (such as from fluid pressure F) may result in the shoulder 633 urged against the end 661.

The end 661 may thus be bumped into the trough T3 of the adjacent groove uphole of crest C3, while surface 662*a* of end 660 may be simultaneously bumped onto the ridge R2, as shown in FIG. 6V. FIGS. 6U and 6V together illustrate the device 614 may transition from a primary armed position to a final armed position, shown in FIG. 6W. That is, once the end 661 of the index sleeve 657 is clear of shoulder 633 (6V), the device 614 may continue moving until the end 660 engages the sleeve seal shoulder 634. Continued force F against the ball 671 results in the shoulder urging the end 660 into a seal pocket 678 on the uphole side of ridge R2, as shown in FIG. 6W (i.e., final armed position). This Figure further shows that the upper end 660 of sleeve 657 may be clear of shoulder 634, but as the device 614 moves further therein the end 660 may bump into the shoulder 633. As the end 660 now resides in the seal pocket 678, there may be no further clearance for the index sleeve 657 to move.

Accordingly, as a last step sequence illustrated by way of FIG. 6X, continued force via pressure against the ball 671 may result in breaking of the members 626, and the valve 602 moving from a first position (6W) to a second position (6X).

When the differential pressure across the ball 671 exceeds the equivalent shear load holding the sleeve 624 in place, the sleeve 624 may shift to the open or second position, exposing the frac ports 623. The second position may include a bias member 628 expanded into a slot 629, which may then hold the device 614 and the sleeve 624 from moving any further downhole.

Although not shown in entirety here, further force against the ball 671 may result in the end 660 urged enough in a sufficient manner to shear members holding the shear ring 674 in place. The resultant effect may be the compression and expansion of a seal element 673 into engagement with an inner surface of the sleeve 624. Regardless of the embodiment used, the seal formed between the device 614 and the frac valve 602 may be useful to isolate a thin walled portion of the device 614 from collapse pressure during the frac, and from compressive forces that could cause buckling. Both of these features may facilitate the inside diameter of the device 614 to be optimized to the maximum diameter possible thereby giving the largest bore (553) flow area therethrough.

The sequence of setting (opening) sleeves of a respective cluster may be repeated with a new device 614 for any preceding clusters. For example, after the first stage is stimulated, a second device 614 may be pumped from the surface downhole. The second device 614 may travel through any predetermined number of valves 602, 602*a* without opening them, with the respective index sleeve 657 able to incrementally shift as described herein. The initial position of the index sleeve 657 may be adjusted to correspond to the number of stages the device 614 needs to travel before opening a desired valve 602.

One or more components of any device of embodiments disclosed herein may be made of reactive materials (e.g., materials suitable for and are known to dissolve, degrade, etc. in downhole environments [including extreme pressure, temperature, fluid properties, etc.] after a brief or limited period of time (predetermined or otherwise) as may be desired). In an embodiment, a component made of a reactive material may begin to react within about 3 to about 48 hours after exposure to a reaction-inducing stimulant.

In embodiments, one or more components may be made of a metallic material, such as an aluminum-based or magnesium-based material. The metallic material may be reactive, such as dissolvable, which is to say under certain conditions the respective component(s) may begin to dissolve, and thus alleviating the need for drill thru. These conditions may be anticipated and thus predetermined. In embodiments, the components may be made of dissolvable aluminum-, magnesium-, or aluminum-magnesium-based (or alloy, complex, etc.) material, such as that provided by Nanjing Highsur Composite Materials Technology Co. LTD or Terves, Inc.

One or more components may be made of non-dissolvable materials (e.g., materials suitable for and are known to withstand downhole environments [including extreme pressure, temperature, fluid properties, etc.] for an extended period of time (predetermined or otherwise) as may be desired). Components may be 3D-printed or made with other forms of additive manufacturing.

ADVANTAGES

Embodiments herein may advantageously solve the problem of pumping efficiency, cost, and water usage by allowing a user to hydraulic fracture more than one pin point location at a time. Systems and methods of the disclosure may reduce displacement water, perf erosion, and significant time on location. This may beneficially allow for reduced personal and services on site, and may thereby provide a simpler install and safer work environment for operators. This system also addresses all problems associated with legacy sleeves designs and plug and perf operations.

Other advantages pertain to use of an identical plugging device, which may reduce risk associated with machining and of installation, as well as reduce quality control risk. In a similar manner, the frac valve (with solid sleeve) and the frac valve (with flex sleeve) may also be manufactured identically, with similar benefits. Saving water, time on location, risk, personal on location, and service company costs (such as for wireline, pump down crew, and drillout) are a huge competitive advantage. When downhole operations run about $30,000-$40,000 per hour, a savings measured in minutes (albeit repeated in scale) is of significance. Again, even a small savings per stage results in an enormous savings on an annual basis.

While preferred embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A downhole system for multistage fracturing a subterranean formation, the downhole system comprising:

a first cluster of valves;

a second cluster of valves downhole of the first cluster;

a third cluster of valves downhole from the second cluster; and a plugging device comprising:

a plug body having a distal end, a proximate end, and an outer surface; and a plurality of grooves disposed on the outer surface;

wherein the plugging device does not open any valves of the first and second cluster of valves, but opens every valve of the third cluster of valves, wherein each of the first cluster of valves, the second cluster of valves, and the third cluster of valves comprise a flex valve comprising a flex sleeve configured with a rigid portion and a flexible portion, and wherein at least one of the first cluster of valves, the second cluster of valves, and the third cluster of valves comprises a frac valve having a solid sleeve configured with an inner sleeve shoulder.

2. The downhole system of claim 1, wherein the flexible portion comprises a plurality of fingers.

3. The downhole system of claim 2, wherein the plugging device further comprises:

an upper sleeve engaged with the proximate end;

an upper fin engaged with the upper sleeve; and an index sleeve movingly disposed on the outer surface, the index sleeve configured to engage the plurality of grooves.

4. The downhole system of claim 1, wherein the plugging device further comprises:

an upper sleeve engaged with the proximate end;

an upper fin engaged with the upper sleeve; and an index sleeve movingly disposed on the outer surface, the index sleeve configured to engage the plurality of grooves.

5. A downhole system for multistage fracturing a subterranean formation, the downhole system comprising:

a first cluster of valves;

a second cluster of valves downhole of the first cluster;

a third cluster of valves downhole from the second cluster; and a plugging device comprising:

a plug body having a distal end, a proximate end, and an outer surface;

a plurality of grooves disposed on the outer surface; and an index sleeve movingly disposed on the outer surface, the index sleeve configured to engage the plurality of grooves;

wherein the index sleeve is set in an initial position before entering the first cluster of valves, wherein the index sleeve is incremented from the distal end toward the proximate end after leaving the first cluster of valves, wherein the index sleeve is moved to a first armed position by one of the second cluster of valves, wherein the plugging device does not open any valves of the first and second cluster of valves, but opens every valve of the third cluster of valves, and wherein each of the first cluster of valves, the second cluster of valves, and the third cluster of valves comprise a flex valve comprising a flex sleeve configured with a rigid portion and a flexible portion.

6. The downhole system of claim 5, wherein the flexible portion comprises a plurality of fingers.

7. The downhole system of claim 6, wherein the index sleeve cannot engage the plurality of fingers unless it is in the first armed position or a final armed position.

8. The downhole system of claim 7, wherein the outer surface comprises an outermost ridge and an extended rib.

9. The downhole system of claim 7, wherein the each of the first cluster of valves, the second cluster of valves, and the third cluster of valves each comprise a frac valve comprising a solid sleeve configured with an inner sleeve shoulder.

10. The downhole system of claim 9, wherein the plugging device engages, but does not open, each of the frac valves of the first and second cluster of valves, and wherein the plugging device engages and opens the frac valve of the third cluster of valves.

11. The downhole system of claim 5, wherein the each of the first cluster of valves, the second cluster of valves, and the third cluster of valves each comprise a frac valve comprising a solid sleeve configured with an inner sleeve shoulder.

12. The downhole system of claim 11, wherein the plugging device engages, but does not open, each of the frac valves of the first and second cluster of valves, and wherein the plugging device engages and opens the frac valve of the third cluster of valves.

13. The downhole system of claim 12, wherein the index sleeve cannot open the frac valve of the third cluster of valves unless the index sleeve is in a final armed position.

14. The downhole system of claim 13, wherein the outer surface comprises an outermost ridge and an extended rib.

15. The downhole system of claim 5, wherein any groove of the plurality of grooves is characterized as having a respective trough and crest, wherein the outer surface comprises an extended rib having an outer diameter larger than any surface of the plurality of grooves, and wherein the outer surface comprises an outermost ridge near the proximate end, the outermost ridge having an outer ridge diameter larger than the outer diameter of the extended rib.

16. The downhole system of claim 15, wherein the plugging device further comprises an upper sleeve engaged with the plug body, wherein an upper fin is engaged with the upper sleeve, and wherein the upper fin is configured with a catch shoulder configured to hold a removable plug in sealing engagement with the upper sleeve.

17. The downhole system of claim 16, wherein the proximate end comprises a shear ring, a seal element, and at least one backup ring disposed therearound.

18. A downhole system for multistage fracturing a subterranean formation, the downhole system comprising:

a first cluster of valves;

a second cluster of valves downhole of the first cluster;

a third cluster of valves downhole from the second cluster; and a plugging device comprising:

a plug body having a distal end, a proximate end, and an outer surface;

an upper sleeve engaged with the proximate end;

an upper fin engaged with the upper sleeve;

a plurality of grooves disposed on the outer surface; and an index sleeve movingly disposed on the outer surface, the index sleeve configured to engage the plurality of grooves;

wherein the index sleeve is set in an initial position before entering the first cluster of valves, wherein the index sleeve is incremented from the distal end toward the proximate end one groove of the plurality of grooves after leaving the first cluster of valves, wherein any groove of the plurality of grooves is characterized as having a respective trough and crest, wherein the outer surface comprises an extended rib having an outer diameter larger than any surface of the plurality of grooves, wherein the proximate end comprises a shear ring, a seal element, and at least one backup ring disposed therearound, and wherein the outer surface comprises an outermost ridge near the proximate end, the outermost ridge having an outer ridge diameter larger than the outer diameter of the extended rib.

19. The downhole system of claim 18, wherein the index sleeve is moved to a first aimed position by one of the second cluster of valves, and wherein the plugging device does not open any valves of the first and second cluster of valves, but opens every valve of the third cluster of valves.

20. The downhole system of claim 18, wherein the upper fin is configured with a catch shoulder configured to hold a removable plug in sealing engagement with the upper sleeve.

* * * * *